US006488019B2

(12) United States Patent
Kotsiopoulos

(10) Patent No.: US 6,488,019 B2
(45) Date of Patent: Dec. 3, 2002

(54) FEEDER FOR A PAINTBALL GUN

(76) Inventor: Thomas G. Kotsiopoulos, 404 Hillcrest, Prospect Heights, IL (US) 60070

( * ) Notice: Subject to any disclaimer, the term of this patent is extended or adjusted under 35 U.S.C. 154(b) by 0 days.

(21) Appl. No.: 09/920,985

(22) Filed: Aug. 2, 2001

(65) Prior Publication Data

US 2002/0020402 A1 Feb. 21, 2002

Related U.S. Application Data

(63) Continuation-in-part of application No. 09/590,589, filed on Jun. 8, 2000, which is a continuation-in-part of application No. 09/513,569, filed on Feb. 25, 2000, now Pat. No. 6,305,367.

(60) Provisional application No. 60/121,795, filed on Feb. 26, 1999.

(51) Int. Cl.[7] ..... F41B 11/02

(52) U.S. Cl. ..... 124/51.1; 124/48; 89/33.17

(58) Field of Search ..... 124/76, 51.1, 82, 124/45, 49, 50, 72, 74, 48; 89/33.01, 33.02, 33.17

(56) References Cited

U.S. PATENT DOCUMENTS

| | | | |
|---|---|---|---|
| 905,401 | A | 12/1908 | Billmeyer |
| 1,743,576 | A | 1/1930 | Smith |
| 2,091,672 | A | 8/1937 | Cleereman |
| 2,590,981 | A | 4/1952 | Lippert |
| 2,828,732 | A | 4/1958 | Horowitz et al. |
| 2,873,650 | A | 2/1959 | Pinkerton, Jr. |
| 3,244,132 | A | 4/1966 | Leichner et al. |
| 3,318,191 | A | 5/1967 | Reed |
| 3,384,269 | A | 5/1968 | Garrett |
| 3,473,434 | A | 10/1969 | Brieger |
| 3,650,177 | A | 3/1972 | Hupp et al. |
| 3,724,325 | A | 4/1973 | Silsby |
| 3,807,379 | A | 4/1974 | Vodinh |
| 3,855,988 | A | 12/1974 | Sweeton |
| 3,878,827 | A | 4/1975 | Newgarden, Jr. |
| 4,023,465 | A | 5/1977 | Inskip |
| 4,034,644 | A | 7/1977 | Hupp et al. |
| 4,116,192 | A | 9/1978 | Scott |
| 4,126,079 | A | 11/1978 | Perrine |
| 4,147,152 | A | 4/1979 | Fischer et al. |
| 4,207,857 | A | 6/1980 | Balka, Jr. |
| 4,292,878 | A | 10/1981 | Brooks et al. |
| 4,328,737 | A | 5/1982 | Nelson et al. |
| 4,348,938 | A | 9/1982 | Gillum |
| 4,434,700 | A | 3/1984 | Aloi et al. |
| 4,523,509 | A | 6/1985 | Thevis et al. |
| 4,566,580 | A | 1/1986 | Aloi et al. |

(List continued on next page.)

FOREIGN PATENT DOCUMENTS

| | | |
|---|---|---|
| GB | 2 271 833 A | 4/1994 |
| GB | 2322438 B | 8/1998 |
| JP | 10-118308 A | 5/1998 |

OTHER PUBLICATIONS

Search Report; Application No. GB 0112887.5; date of search: Aug. 29, 2001.

*Primary Examiner*—Charles T. Jordan
*Assistant Examiner*—Troy Chambers
(74) *Attorney, Agent, or Firm*—Leydig, Voit & Mayer, Ltd.

(57) ABSTRACT

A feeder for use with a paintball gun has an inlet through which paintballs enter, and an outlet through which they exit. A feed mechanism disposed inside the feeder frictionally engages the paintballs as they enter and transports them to the outlet. The feed mechanism may include rotatable disks. The space between the rotatable disks may be less than the diameter of the paintballs. At least one of the rotatable disks may include a material that flexes to accommodate a paintball. The paintball feeding system may additionally incorporate a circuit that senses when the gun is fired and controls the rate at which paintballs are fed into the paintball gun.

20 Claims, 24 Drawing Sheets

U.S. PATENT DOCUMENTS 4,616,622 A 10/1986 Milliman
4,819,609 A 4/1989 Tippman
4,881,447 A 11/1989 Yanusko et al.
4,936,282 A 6/1990 Dobbins et al.
4,986,251 A 1/1991 Lilley
5,070,762 A 12/1991 Long et al.
5,097,985 A 3/1992 Jones
5,280,778 A 1/1994 Kotsiopoulos
5,282,454 A 2/1994 Bell et al.
5,335,579 A 8/1994 David
5,349,939 A 9/1994 Perrone
5,383,442 A 1/1995 Tippman
5,413,083 A 5/1995 Jones
5,456,153 A 10/1995 Bentley et al.
5,497,758 A 3/1996 Dobbins et al.
5,505,188 A 4/1996 Williams
5,511,333 A 4/1996 Farrell
5,572,982 A 11/1996 Williams
5,722,383 A 3/1998 Tippmann, Sr. et al.
5,736,720 A 4/1998 Bell et al.
5,791,325 A 8/1998 Anderson
5,794,606 A 8/1998 Deak
5,809,983 A 9/1998 Stoneking
5,816,232 A 10/1998 Bell
5,839,422 A 11/1998 Ferris
5,915,590 A 6/1999 Yeh
5,947,100 A 9/1999 Anderson
5,954,042 A 9/1999 Harvey
6,055,975 A 5/2000 Gallagher et al.

FEEDER FOR A PAINTBALL GUN

CROSS REFERENCE TO RELATED APPLICATIONS

This application is a continuation-in-part of prior U.S. patent application Ser. No. 09/590,589, filed Jun. 8, 2000 which is a continuation-in-part of U.S. patent application Ser. No. 09/513,569, filed Feb. 25, 2000, now U.S. Pat. No. 6,305,367 which claimed priority to U.S. Provisional Patent Application Ser. No. 60/121,795, filed Feb. 26, 1999, the entire disclosures of which are incorporated by reference herein.

FIELD OF THE INVENTION

The present invention generally relates to paintball guns, and more particularly relates to feeder apparatuses used in feeding of paintballs to paintball guns.

BACKGROUND OF THE INVENTION

The game of paintball is one in which two or more "military" teams try to capture one another's flags. The players on the teams each typically carry a compressed gas-powered gun that shoots paintballs—gelatin or plastic spherical capsules which usually contain a colored liquid. When a player is hit with a paintball from an adversary's gun, the paintball ruptures and leaves a colored "splat" on the hit player who is then "out" and must leave the game.

As the game of paintball has grown in sophistication, semiautomatic paintball guns—guns that sequentially fire individual paintballs as fast as the trigger can be repeatedly pulled—have become more prevalent. The high firing rate capability of semiautomatic paintball guns has necessitated the use of bulk loader devices in conjunction with such guns.

Generally, a paintball gun assembly includes a storage container, such as a hopper feeder adapted to internally store a relatively large quantity of paintballs (for example 100–200 paintballs) Connected to the storage container is one or more feed tubes connected to the gun's infeed.

During normal operation of the paintball gun assembly paintball jams intermittently occur in the storage container and/or feeder tube(s). These jams prevent the normal delivery of paintballs, with the result that the paintball stack can be totally depleted by several shots of the gun. Similar jams may occur in the feed tube, thereby preventing delivery of paintballs to the paintball gun's infeed.

In the past, clearing of such jams has required that the gun be forcibly shaken to dislodge the paintballs causing the jam within the storage containers and/or for the feed tube to be manually cleared. Such solutions are undesirable since it at best interrupts the proper aiming of the paintball gun and, of course, correspondingly interrupts the gun user's ability to continue the rapid firing of the gun, and may at worse render the gun temporarily unusable.

SUMMARY OF THE INVENTION

In accordance with this need, a feeder for a paintball gun is provided According to one embodiment, the feeder includes a housing having an inlet channel for receiving paintballs and an outlet channel for delivering paintballs to a paintball gun. Disposed within the housing is a feed mechanism rotatably mounted within the housing that is used to transport the paintballs from the inlet portion of the housing to the outlet portion of the housing so that paintballs are delivered to the paintball gun as needed. The feeder mechanism may, for example, be rotatably mounted on a spindle on the feeder housing.

The feed mechanism may include one or more flexible or complaint rotating disks which are spaced apart by a distance less than the diameter of the paintball. This allows the feed mechanism to frictionally engage the paintball, and facilitates the process of the moving the paintball from the inlet channel to the outlet channel. A motor, also disposed within the housing, rotates the feed mechanism as needed, typically in response to the firing of the paintball gun. Preferably, the motor is selectively operable by a control circuit connected to a sensor that detects the firing of the gun.

In an embodiment of the invention, the feed mechanism includes a first and second rotating disk which are used to frictionally engage the paintball. The first and second rotating disks are spaced apart by a distance less than the diameter of the paintballs such that feed mechanism can frictionally engage the paintballs thereby facilitating their movement in the feeder. At least one of the two rotating disks is flexible in order to accommodate the frictional engagement without breaking the paintballs. The spacing between the first and second rotating disk can be maintained by a disk spacer which can be constructed of a cylindrical disk interposed between the first and second rotating disks.

The housing can be formed from two shells such that the feed mechanism, motor, a battery and other components that may optionally be included are enclosed thereby protecting the feeder components from dust, dirt and corrosion. The housing may include first and second chambers for holding the feed mechanism and the motor.

The feeder may include a control circuit connected to a sensor. The sensor may be integrally mounted on the paintball feeder. Alternatively, the control circuit can connect to an external device that provides a positive or negative signal when the paintball gun is fired. Generally, the control circuit activates the motor for a predetermined period of time in response to signals received from the sensor or external device. In an aspect of the invention, the period of time that the motor remains active is user adjustable. The sensor may be, for example, an accelerometer, sound detector, vibration detector or air pressure sensor.

The motor which is used to rotate the feed mechanism can either be directly coupled to the feed mechanism in order to achieve rotation, or alternatively, may indirectly drive the feed mechanism. In the latter case, a drive mechanism may include one or more drive components coupled to the to the feeder mechanism. The drive components can either be directly coupled to a shaft on the motor, or alternatively, through a belt which frictionally engages both the motor shaft and one or more of the drive components.

The invention may be better understood with reference to the accompanying drawings and in the following detailed description of the preferred embodiments.

DETAILED DESCRIPTION OF THE INVENTION

For purposes of an understanding of the invention, reference will now be made to the apparatus as shown in the figures and specific language will be used to describe the same. It will nevertheless be understood that no limitation of the scope of the invention is thereby intended, and that the apparatus shown therein represents only some of the features of the claimed invention. For convenience, the description of the invention below is divided into discussion of (a) in-container paintball feeders and (b) paintball feeders positioned in the paintball feed between the exit of the paintball storage container and the infeed of the paintball gun. Of course, such division does not represent and should not be construed as a limitation on the scope of the present invention.

Figure 1:
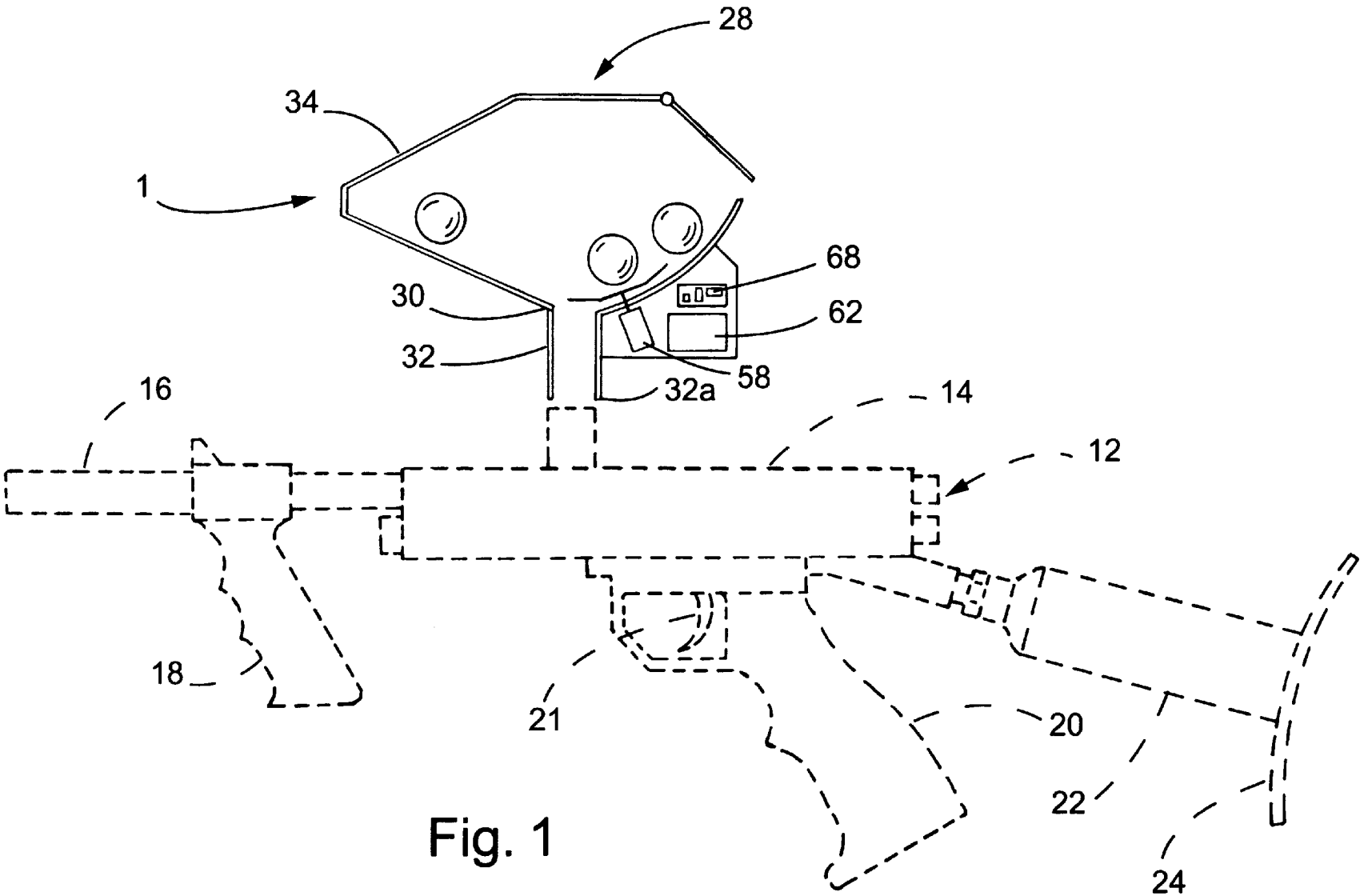
FIG. 1 is a side elevational view of a hopper feeder which embodies principles of the present invention operatively attached to a representative paintball gun illustrated in phantom.

Illustrated in FIG. 1 is an exemplary "in container" or hopper feeder apparatus 1 that embodies principles of the present invention and is operatively connected to a representative paintball gun 12 of conventional construction and operation, the paintball gun being shown in phantom. The paintball gun 12 is representatively of the semiautomatic firing type and has a body portion 14; a barrel 16 with a front handgrip 18 depending therefrom; a central handgrip 20 having a trigger 21; and a rear stock portion defined by a $CO_2$ or more typically $N_2$, propellant gas canister 22 and provided at its rear end with a crooked shoulder rest portion 24.

The paintball gun is conventionally fitted with an infeed portion in the form of a hollow, open-ended infeed. In a manner subsequently described, paintballs stored within the hopper 10 are gravity fed downwardly into the firing chamber for sequential firing from the gun by pressure bursts from canister 22 created by sequential pulls of the trigger 21. While the present invention is described here with reference to a paintball gun having the previously mentioned features, it will be clear that it can be used with any type of paintball gun, such as tournament-level paintball guns which use compressed gas and do not have stocks.

Figure 2:
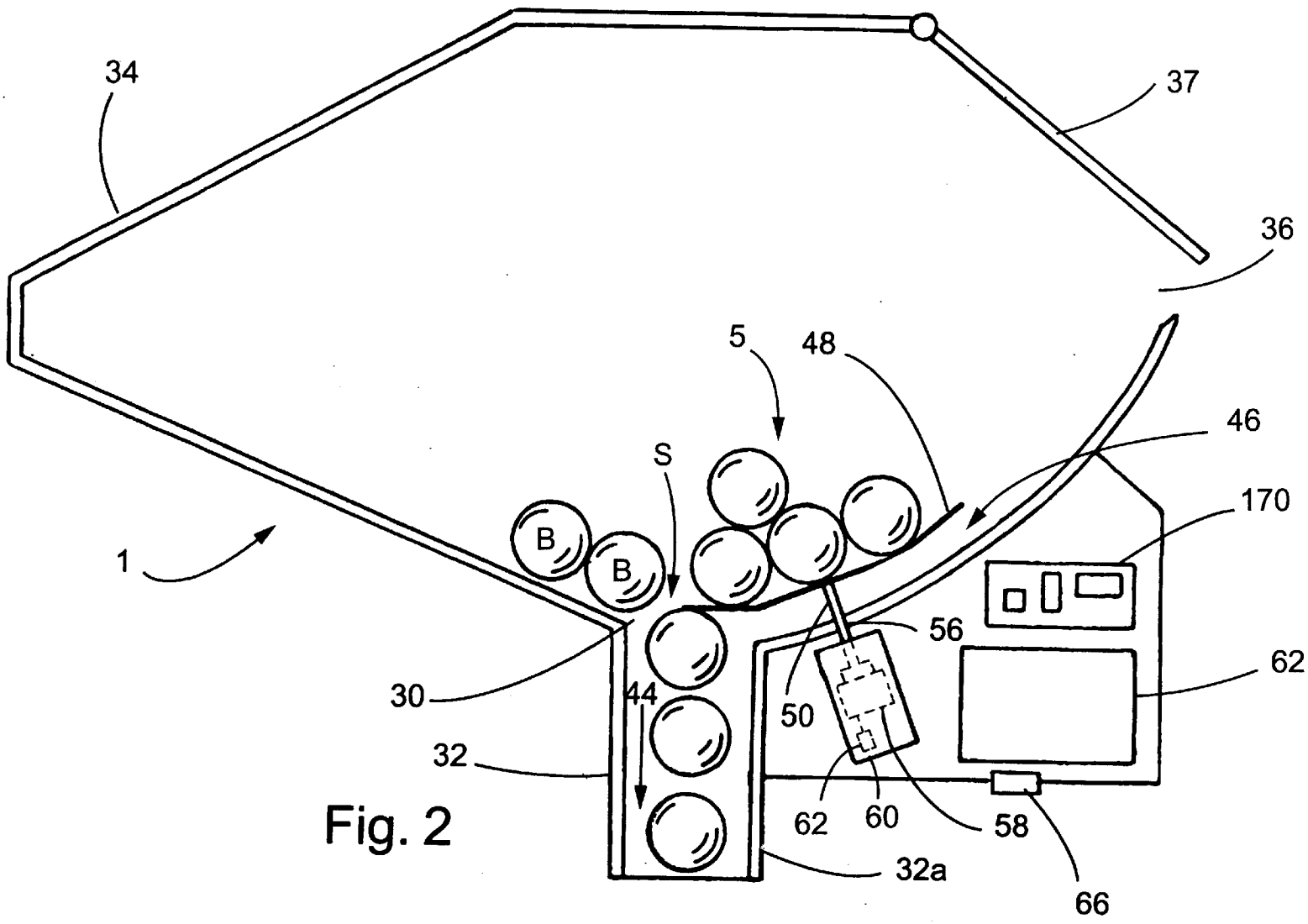
FIG. 2 is an enlarged scale, partially cut away side elevational view of the gravity hopper feeder during normal paintball feeding thereof to the gun.

Referring now to FIGS. 1–2, the hopper feeder has a hollow housing 1 (or hopper) positioned above the gun body 14 and adapted to internally receive and store a quantity of paintballs 5. Housing 28 is conveniently of a molded plastic construction and is bent along a downwardly curved longitudinal axis. Housing 28 has a closed front end 34 and rear opening 36 which is covered by a hinged lid 37 through which paintballs are loaded in the hopper. An outlet opening 30, preferably circular, is formed in the bottom side of the housing 28. The outlet opening 30 has a diameter or is otherwise somewhat larger than the diameters of the stored paintballs 5, so that the paintballs can sequentially drop downwardly through opening 30 into a feed tube portion 32 of the gravity hopper feeder. The feed tube 32 is secured to housing 28, over its outlet opening 30, and extends generally downwardly from the housing 28. The housing 28 is connected to the paintball gun 12, by the feed tube 32, more particularly by the feed tube's lower end portion 32*a*, which is preferably removably received by the gun 12.

Turning now to FIG. 2, during normal operation of the paintball gun, the housing-stored paintballs 5 sequentially fall downwardly through the housing bottom outlet opening 30 and form a paintball stacks within the feed tube 32 and the gun infeed 26 to which the feed tube is removably connected. As the paintball gun is repeatedly fired, the paintballs moves downwardly into the gun, as indicated by the arrow 44, and are continuously replenished at the top end of the feed tube 32 by additional paintballs 5 falling through the housing outlet opening 30.

Paintball jams are prevented via an automatic jam preventing system generally designated by the reference numeral 46. The jam preventing system 46 includes an agitator paddle 48 disposed within the housing 28 outwardly adjacent its outlet opening 30 and centrally supported on a shaft 50 for driven rotation within the housing. When the member 48 is rotationally driven in this manner, its outer ends sweep intermittently through an interior section of the housing 28 positioned above an outer portion of the housing outlet opening 30 as viewed in FIG. 2.

The shaft 50 extends downwardly through a small opening in the bottom side of the housing 28 and is connected to the output shaft 56 of a small electric motor 58 disposed within a casing 60 secured to the underside of the housing 28 behind the feed tube 32. Motor 58 is powered by a small DC storage battery 62 also disposed within the casing 60. Alternatively, separate casings for the components of the system (e.g., battery and motor) can be used. The jam preventing system 46 may be selectively activated and deactivated using a manual on/off switch 66 externally mounted on casing 60.

System 46 also includes a sensor 170 such as an accelerometer, a sound detector, a pressure sensor, or other suitable detector, which detects the firing of the paintball gun. Such sensors are of a conventional construction and have emitter and receiver/switch portions. The sensor is preferably combined with a control, such as a control circuit. The motor 58, the battery 62, the on/off switch 66 and the sensor 68 are electrically connected in series with one another. Alternatively, the control circuit can be designed such that an on/off switch is not required. The sensor, control, motor, battery and switch can be used in either aspect of the present invention, and are further described elsewhere herein.

With the on/off switch 66 in the on position to activate the jam preventing system 46, the sensor 68 detects the firing of the paintball gun. The rotationally driven agitator member 48 is actuated and engages and stirs the paintballs in the housing near the outlet 30. The stirring prevents jamming of the paintballs ensuring that they fall through the outlet opening 30 onto the top of the paintball stack S, as indicated by the positions of the paintballs $B_1$ and $B_2$. The agitator runs for about 0.5 seconds although the amount of time the motor remains active may be any suitable time period and is preferably adjustable. After the time period expires, the agitator preferably shuts off automatically. Each time the trigger is activated and the sensor detects a firing the agitator is activated. Preferably, the feed tube is filled to aid the transport of paintballs between the housing and the paintball gun. The operation of the system maintains jam free feeding of the paintballs into the feed tube, and subsequently to the paintball gun for firing.

Figure 3:
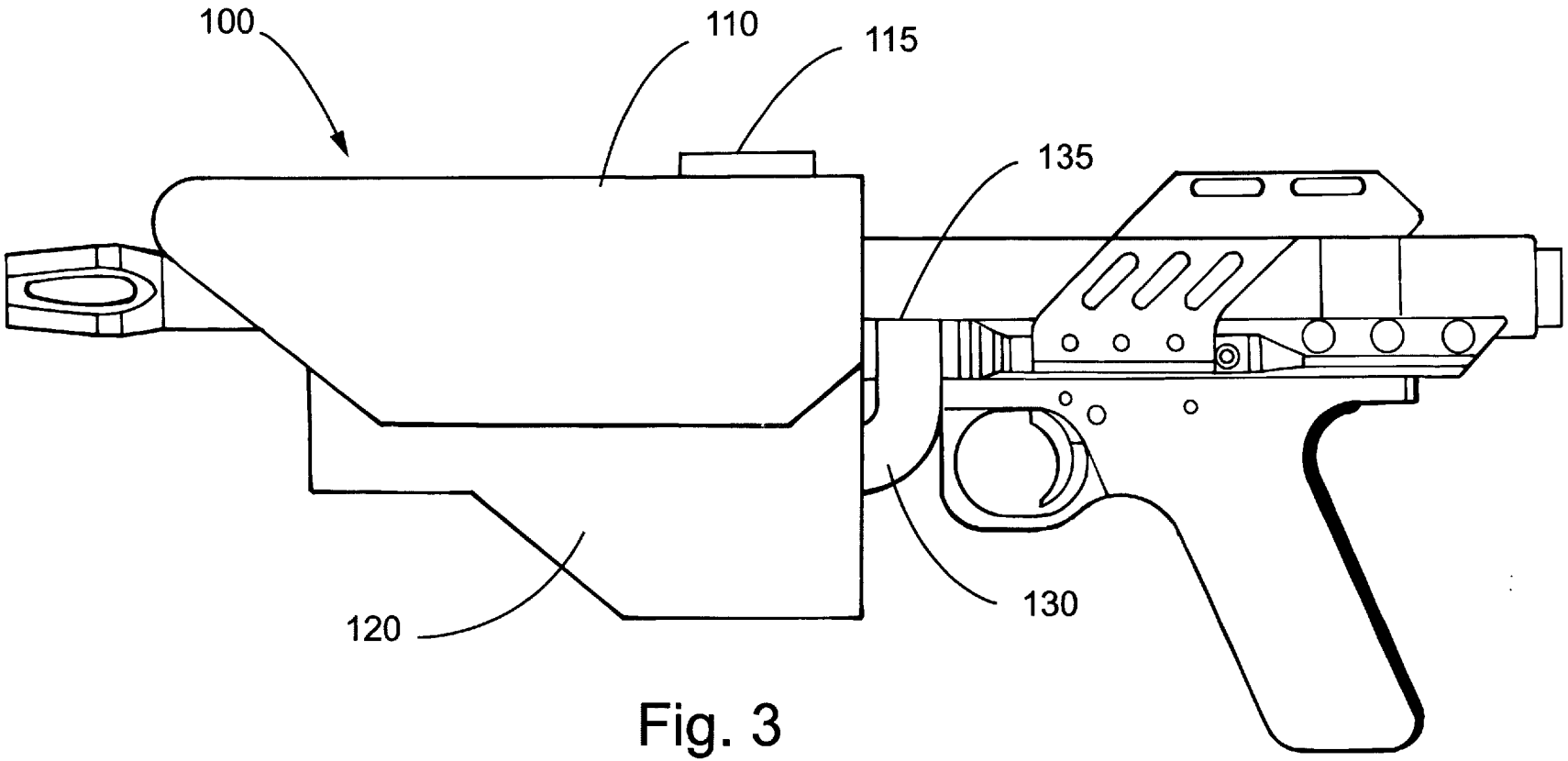
FIG. 3 is an exterior view of a paintball gun incorporating a conveyor hopper feeder apparatus of the present invention.

In a second embodiment, a conveyor feed, in-container paintball feeder system is provided, as shown in FIG. 3. The conveyor feed system includes a housing 110, the lower portion 120 of which contains a conveyor feed (not shown). The conveyor feed system transmits paintballs from the bottom of the housing 120 through a feed tube 130 and into the gun 100. Due to the positive motion of the conveyor feed system, the feed tube 130 can enter the gun 100 in any orientation. For example the feed tube 130 can exit the housing at a point lower than the point of entry 135 into the gun, as shown in FIG. 3.

Due to the positive motion provided by the conveyor feed system, the conveyor feed system can be positioned at various positions with respect to the gun (i.e., not necessarily above the gun). For example, the housing can be positioned to the side of the gun or around the body of the gun, with a feed tube positioned at the bottom of the housing and traveling upward to enter the gun. In such aspects, the housing may be less subject to protrusion in the gun operator's line of sight, which might otherwise block the gun operator's vision. Furthermore, by lowering the housing more in line with the paintball gun, the target area of the player with the gun is comparatively reduced. Further, the conveyor feed system only requires contact with the paintball gun by the feed tube. Conveniently, the conveyor feed system can be readily removed from the immediate proximity of the gun and be placed in, for instance, a backpack unit, reducing the total area of the gun available to an opponent's fire and making the gun less awkward to carry.

Figure 4A:
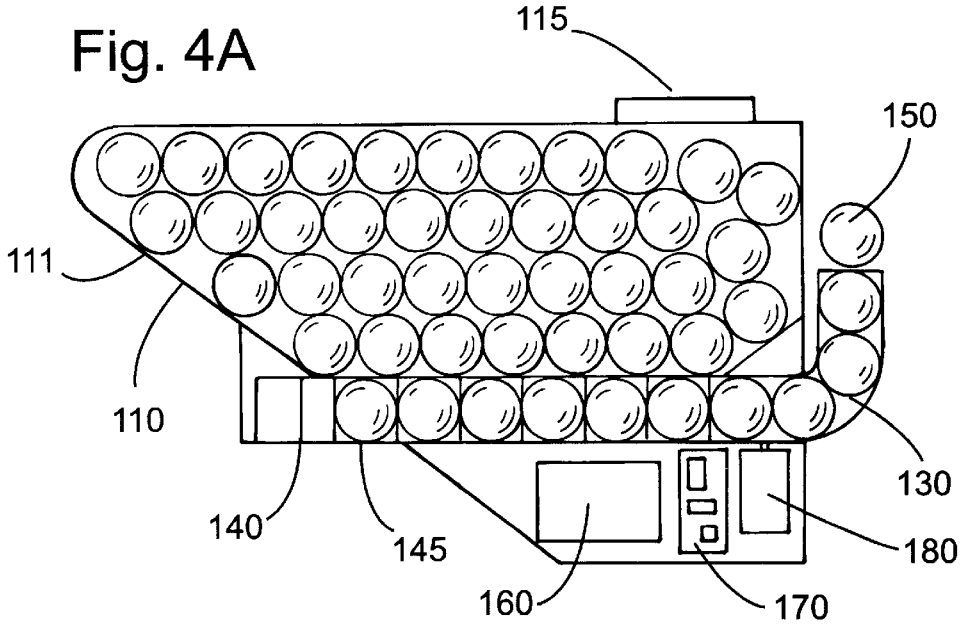
FIG. 4A is a side cutaway view of a conveyor hopper feeder aspect of the present invention.

FIG. 4A shows a side cutaway view of an exemplary conveyor feed system of the present invention. The gun operator feeds paintballs into the housing through an inlet 115. Preferably, the housing includes a cover (not shown), which closes the inlet. The paintballs in the housing 110 typically move gravitationally to the lower portion 120 of the housing shown in FIG. 3. In the housing's lower portion 120, the paintballs either fit within the spaces formed by the holders 140 which are attached to the conveyor (not shown) or are held in the housing lower portion above the balls held within the holders 140.

Figure 4B:
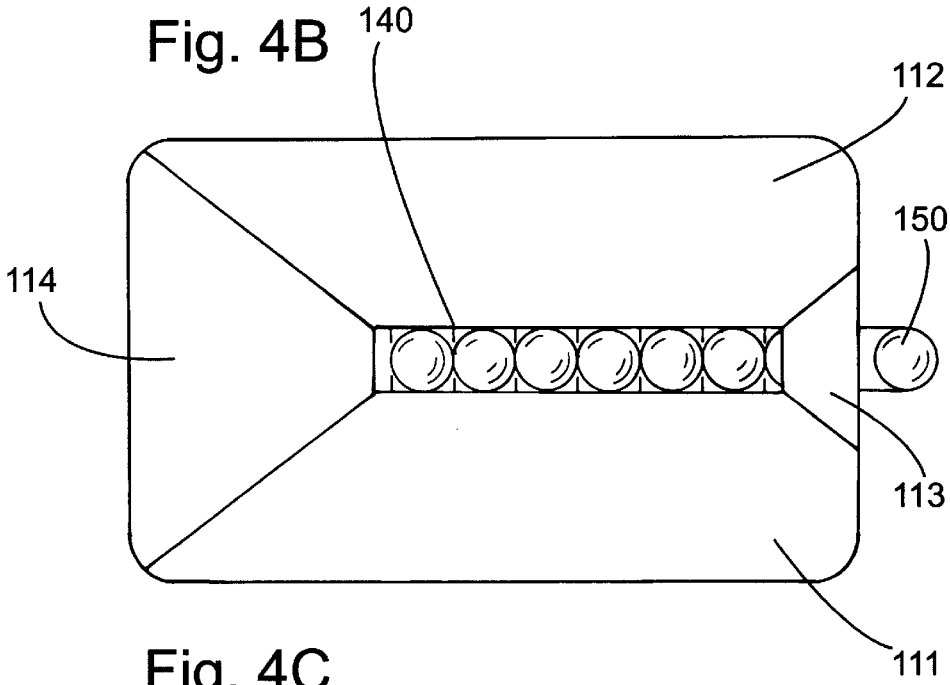
FIG. 4B is a cutaway top view of the of the conveyor hopper feeder aspect shown in FIG. 4A.

Typically, the shape of the housing will control the way that the paintballs will drop between the holders, improving the efficiency of the system in avoiding jams and providing paintballs to the gun. Preferably, the only area that is exposed in the bottom of the housing is the channel formed between the conveyors where the paintballs are transported by the holders, as seen in FIG. 4B. For example, the housing 110 can be shaped such that slanting side walls 111 and 112 are sloped to guide paintballs to the conveyor as they approach the bottom of the housing. Additionally, sloping sections in the front 113 and rear 114 of the housing additionally guide the paintballs through the housing to the conveyor promoting efficiency of the system in reducing jams. The housing can take any suitable shape and orientation. For example, the upper portion of the housing can be divided into two portions where it is desired to place the housing below and around the gun.

Figure 6:
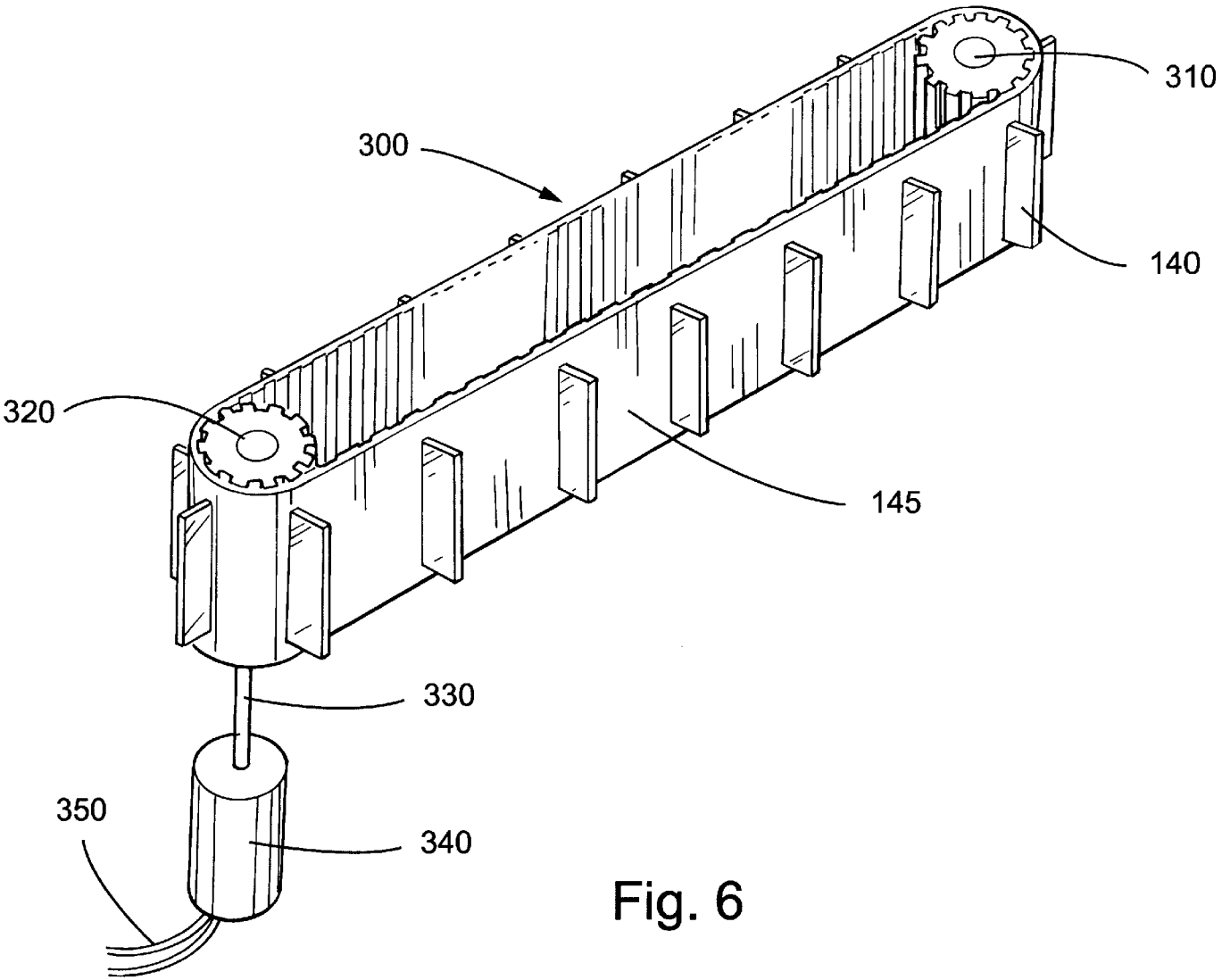
FIG. 6 is a tiled side view of a conveyor hopper feeder system of the invention.

In a single conveyor belt system, after the paintballs are guided to the bottom of the housing 110, they fall onto the conveyor belt 145 between the holders 140. The conveyor system can be any suitable conveyor system for moving paintballs through the bottom of the housing and into the feed tube (and preferably into the housing thereafter). Preferably, the conveyor system consists of a conveyor belt 145, two wheels (not shown) and a number of holders 140 (e.g., paddles) extending from the surface of the belt 145, as seen in FIG. 4A and FIG. 6. As shown in the exemplary conveyor system 300 in FIG. 6, it is preferred that one wheel is driven wheel 320 and the other wheel a free spinning wheel 310. The conveyor belt 145 can be any suitable conveyor belt. Suitable conveyor belts should have enough tension from the wheels to make the conveyor belt rotate with the driven wheel 320. The driven wheel 320 is attached to a drive shaft 330, which is attached to a motor 340, such as a DC motor as described elsewhere herein, which is further attached by a connector 350 to a power source, such as a battery.

The holders 140 can be of any suitable type of holder for transmitting the paintballs, such as conveyor paddles. Preferably, the holders 140 are capable of flexing at pressures lower than the force required for breaking a paintball, but are sufficiently sturdy enough to move the paintballs through the housing and into the gun. The number of holders attached to the conveyor belt will depend upon the length of the conveyor system, and the type of paintball that the system uses. One of ordinary skill in the art will readily be able to select a conveyor with an appropriate number of paddles based upon these two factors.

Figure 4C:
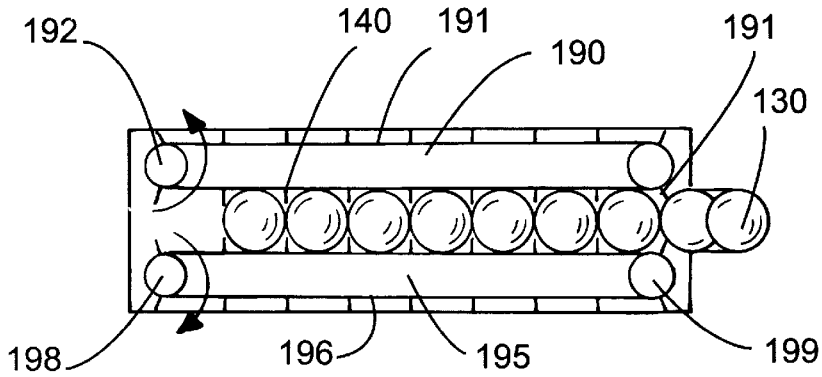
FIG. 4C is a top cutaway view of a conveyor hopper feeder aspect of the present invention incorporating two conveyor belts.

FIG. 4C provides a top cutaway view of an alternate conveyor feed system of the invention, focusing on the conveyor system therein. In this system, the conveyor system comprises a first conveyor 190 and a second conveyor 195, in contrast to the single conveyor system previously described. A first conveyor belt 191, attached to the first conveyor 190, moves in a first orientation (e.g., counterclockwise, as shown) through the operation of a first drive wheel 192 and a first free spinning wheel 191. A second conveyor belt 196 is attached to a second conveyor 195 and moved around a second drive wheel 198 and a second free spinning wheel 199. The second conveyor belt 196 runs parallel to the first conveyor system but moves in a second opposite orientation, to move the holders 140, and thus the paintballs, in the same direction, through the bottom of the housing 120 to the feed tube 130.

In operation of the conveyor feed system of the invention, paintballs move and/or are guided to the conveyor belt 145 in a single conveyor system (as shown in FIG. 4A), or the channel formed between two conveyors 197, in a two conveyor system (as shown in FIG. 4C). The moving holders 140 then transport the paintballs through the bottom of the housing 120 and force the paintballs into the feed tube 130. Preferably, the feed tube 130 is filled prior to operation to aid in the transport of the balls between the housing and the paintball gun. The paintballs are subsequently transported through the feed tube into the gun at the paintball gun's infeed 150. As paintballs move out of the housing 110, other balls contained in the lower portion of the housing are permitted to fall between the holders, thus preventing jams in the housing. Due to the positive motion of the conveyor, versus the passive gravity feed in other aspects of the invention, the conveyor feed approximately doubles the rate of transferring paintballs from the housing to the gun. More particularly, the conveyor feed of the present invention can feed paintballs at a rate of up to about 52 paintballs per second, compared to about 26 paintballs per second for hopper feeder systems. Maximum firing rates typically are approximately equal to one half paintball feeding rates. Thus, paintball gun assemblies incorporating the conveyor feed system can fire at about 26 paintballs per second, compared to about 13 paintballs per second for hopper feeder systems which do not include the conveyor feeder system. The conveyor feed system is operated by a sensor and control circuit that detect the firing of the paintball gun and operate the system, preferably for a set period of time, in response to each firing.

Figure 5A:
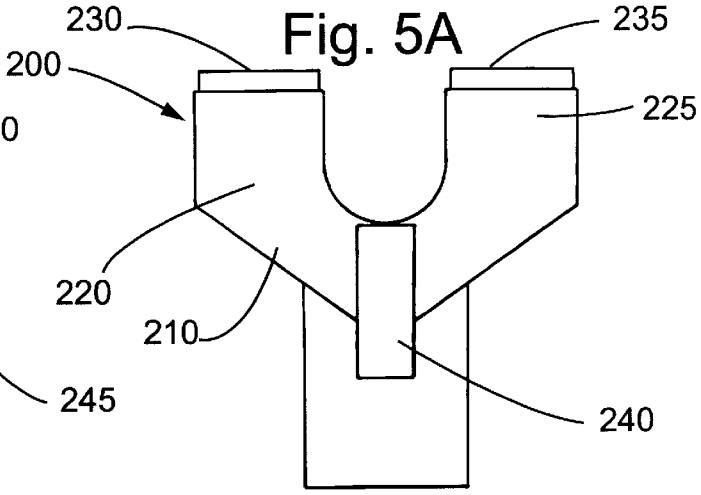
FIG. 5A is a rear view of an alternate conveyor hopper feeder embodiment of the invention, having two upper housing chambers.
Figure 5B:
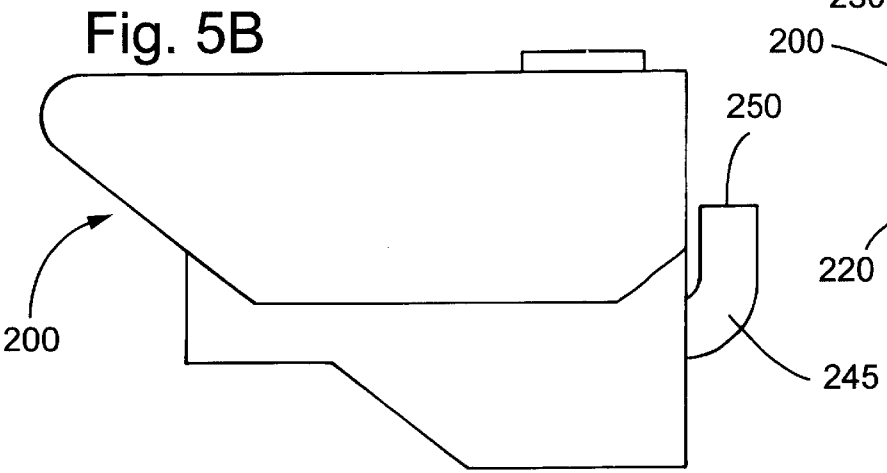
FIG. 5B is a side view of the alternate embodiment shown in FIG. 5A.
Figure 5C:
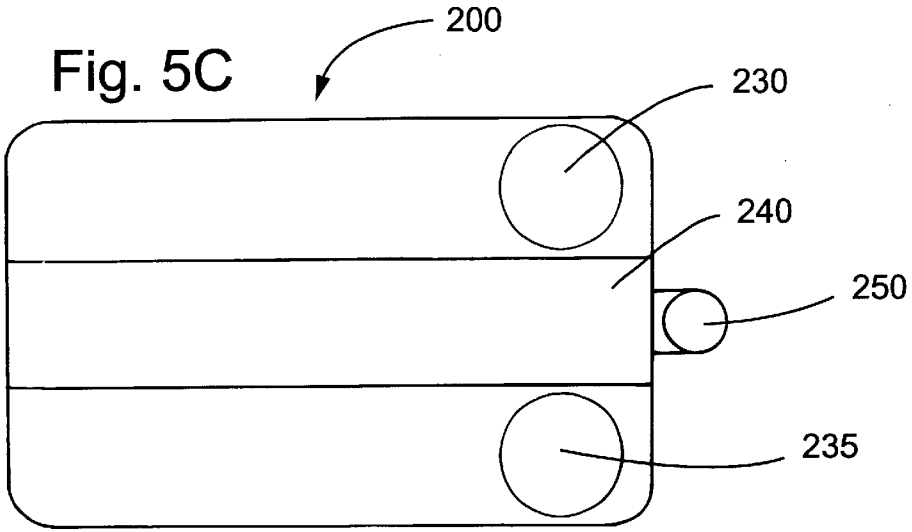
FIG. 5C is a top view of the alternate embodiment shown in FIG. 5A.

The housing can take any suitable shape in the context in the present invention. Typically the housing will comprise a single chambered hopper, as shown in, for example, FIG. 1. FIGS. 5A, 5B and 5C show an alternative aspect of the present invention, wherein a housing 200 includes a first upper housing chamber 220 and a second upper housing chamber 225, positioned on opposite sides of a conveyor feed system 240. The first upper housing chamber 220 is provided with an opening 230, and the second housing chamber 225 is provided with a separate opening 235, each for feeding paintballs into the feeder portion of the housing 200. In such an embodiment the first upper housing chamber 220 and second upper housing chamber 225 preferably slant downward at the lower ends thereof and direct the paintballs to the conveyor feed 240, to promote efficiency of the system in preventing jamming and delivering paintballs to the gun's infeed 250 by way of the feed tube 245.

According to an aspect of the invention, the sensor and control unit 170 (FIGS. 1, 2 and 4A) senses the firing of the gun and activates control jam preventing system 46 and/or the feeder system of FIGS. 3, 4A, 4B and 4C. Although shown as a combined component, the sensor and control can be separate components. The unit 170 can be implemented in a variety of ways. For example, the unit 170 can be an accelerometer, preferably which is mounted in the housing. The accelerometer detects the shock/recoil of the gun when it is fired and can be set to pick up a specific range of force, and a set duration. By programming the accelerometer sensor in such a fashion, the feeder will not activate when the gun is accidentally dropped, but only when the gun is fired. Accelerometers and their control are well known in the art, and one of ordinary skill in the art will readily be able to select an appropriate type and settings for use in a feeder system of the present invention. A single axis accelerometer, model number ADXL150, and commercially available from "Analog Devices" is known to be suitable.

Alternatively, as described herein, a sensor which detects sound can be utilized. Such a sensor would be set to detect specific decibel levels and frequency, which would trigger the operation of the feeder. An other alternative is a sensor directed to pressure. Such sensors would typically utilize a remote pilot tube to pick up pressure that is escaping the gun and causing the operation of the feeder when a particular pressure is reached. The control circuit for the feeder system and/or jam preventing system may be a component of a combined sensor-control, and will preferably include a timer that activates the conveyor feed, or agitator, for a set time period after the sensor triggers the operation of the control circuit.

Referring to FIG. 4A, a motor 180 drives the operation of the conveyor in response to signals from the sensor and control unit 170. Any suitable motor can be used in the present invention. Preferred motors are small lightweight motors that can be contained in the housing, such as motors similar to those used in remote control cars. Such motors typically are either 10 or 12 volt DC motors. Varying the voltage of the motor used varies the speed at which the feeders of the invention operate. For example, paintball feeder systems which incorporate a conveyor feed system and a motor which operates with a 10 volt battery is typically associated with a paintball feed rate of about 52 paintballs per second, and a firing rate of about 26 paintballs a second. Lower voltage batteries and motors will provide lower feed and firing rates. Several lightweight and suitable motors are known in the art, and one of ordinary skill in the art will readily be able to determine a suitable motor. Preferably, as shown in FIG. 4A, a battery 160, such as a DC battery, powers the motor 180. The movement of the conveyor, as controlled by the control, effects movement of a new paintball into firing position each time the gun is fired and prevents jams. As previously mentioned, unless otherwise expressed or clear from context the principles applicable to the motor, battery, sensor and control for both aspects of the in-container feeders of the invention are the same, and thus references to these elements elsewhere herein are applicable to the aspects of the invention described immediately above, and visa versa.

Figure 7:
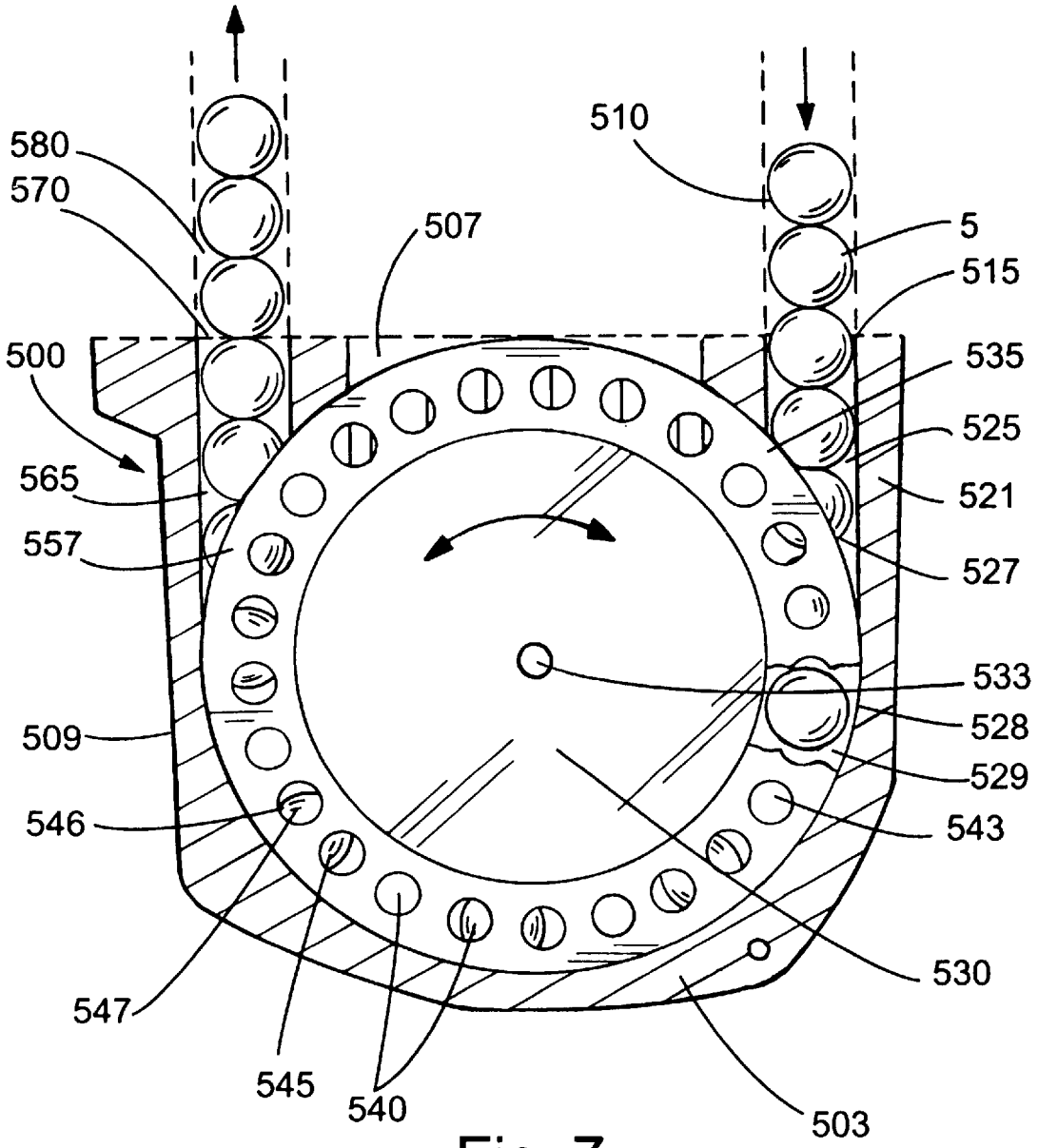
FIG. 7 is a schematic view of a self-contained rotational disk feeder of the invention.

In a further embodiment, a paintball feeder is provided, as shown in FIG. 7. The paintball feeder, generally labeled, 500 typically includes a casing 503 having a partially hollowed out interior into which an elevated u-shaped body portion 507 is fit, molded or machined and around which an elevated unshaped side wall 509 is positioned. The body portion 507 and the side wall 509 together form an inlet channel 525, a drive channel 529 (partially shown at cutaway portion 528), and an outlet channel 565. The body portion 507 is connected to, or integrally formed with, the side wall 509. Typically, and preferably, the casing 503 is formed of a single component (such as from a single molded plastic form) rather than having separated body portion 507 and side wall 509. The casing 503 can be formed of any suitable material. Preferably, the casing 503 is made of a rugged durable plastic, such as polyethylene. Alternatively, for example, the feeder casing 503 can also be made of nylon.

Paintballs 5 feed from a hopper or other paintball container into the feeder 500 through a first feed tube 510. Paintballs in the feed tube(s) used with the feeders of the present invention are typically, though not necessarily, fed close in succession and may be in contact with each other. In such aspects, the sequential feeding of paintballs assists their movement through the feed tube and into the feeder. Other techniques for moving paintballs through the feed tube can be used as discussed herein. Commonly, for example, gravitational feed of paintballs through a feed tube connected to a paintball hopper positioned above the feeder is used (not shown).

Fed from the first feed tube 510, the paintballs 5 will enter the feeder's casing 503 at an entrance or inlet 515, to the inlet channel 525, typically due to the contact of paintballs upstream of those entering the entrance 515 brought about by the sequential feed of the paintballs into and through the first feed tube 510. After entering the casing 503, the paintballs 5 travel through the inlet channel 525. The inlet channel 525 is preferably in the form of a tunnel or unshaped channel formed in the casing 503. The paintballs 5 travel through the inlet channel 525 until reaching a contact area 527 at the beginning of the drive channel 529. The paintballs engage the interior side of a first moveable component, which, in the embodiment provided in FIG. 7, is in the form of a rotating disk 530, the center of which is mounted onto the body portion 507 of the apparatus 500 (mounting portion not shown). The outside edge of the rotating disk 530, positioned above the drive channel 529, engages the paintballs and drives the paintballs through the drive channel 529. Similar to the inlet channel 525, the drive channel 529, is formed in the casing between the elevated body portion 507 and the elevated side wall 509.

Once engaged by the rotating disk 530, the paintballs 5 are fed through the feeder 500 through the drive channel 529 to an exit 570. Typically, though not necessarily, the paintballs in the drive channel are fed through in close succession and thus may be in contact with one another during operation of the feeder. The rotating disk 530 rotates around a central passageway 533, which typically contains a bracing screw or other equivalent component for holding the components or the device together (not shown). Preferably, the rotating disk 530 is capable of rotation in either a clockwise or counterclockwise direction.

In accordance with the present invention, the space between the rotating disk 530 and the opposing side of the drive channel 529 is less than the diameter of the paintballs 5, which is typically about 0.7 in, and more typically about 0.68 in. The space between the rotating disk 530 and the opposing side of the drive channel 529 can be any suitable distance to allow the rotating surface to frictionally engage, and rotationally urge, the paintball after such engagement. Notably, the distance need not be much less than the diameter of the paintball and should not be so small as to prohibit movement on the paintball through the feeder under normal operating conditions. For example, a distance between the rotating disk 530 and the opposing side of the drive channel of only 0.03 in. to 0.055 in., or even 0.01 in., less than the diameter of the paintballs used in the feeder is suitable.

The rotating disk 503 can be any suitable thickness which allows the disk to yield to a paintball 5 upon contact and to urge the paintball through the feeder 500. The thickness of the rotating disk 530 will depend upon the type of material used to form the disk. Generally, thin disks are preferred (e.g., about 0.30 in. to about 0.125 in. thick, more preferably about 0.5 in. to about 0.7 in. thick). Typically more compliant materials can be associated with thicker disks, while generally less compliant disks must be thinner. The rotating disk may be formed from any suitable material which will allow the disk to yield to a paintball. For example, the rotating disk may be formed of a natural or synthetic rubber or a polyurethane. Polyurethane materials are preferred. The rotating disk can be of any suitable hardness which will allow it to be compliant to the paintball. Preferably the rotating disk is made of a material with a hardness of between about 70 and about 100 measured by a Shore A durometer. More preferably, the rotating disk is formed of a material having a hardness of about 90 measured by a Shore A durometer.

As stated above, the rotating disk 530 will be formed of a flexible material, which is compliant (i.e., yields in position to) the paintball 5 when the paintball 5 is brought in contact with the rotating disk 530. Thus, when the paintballs 5 contact the rotating disk 530, the contacting portion 535 of the rotating disk 530 is pushed outward away from the drive channel 529 allowing the paintball 5 to fit between the rotating disk 530 and the opposing side of the drive channel 529. In this position, the rotation of the rotating disk 530, urges the paintballs 5 to move through the drive channel 529 and into the outlet channel 565. Although the paintballs 5 fit between the rotating disk 530 and the opposing side of the drive channel 529, the paintballs once engaged still can slip in relation to the motion of the rotating disk 530. Thus, while the movement of the rotating disk 530 urges the paintballs through the feeder, the movement of the rotating disk 530 in relation to the movement of the paintballs 5 it not necessarily in a consistent 1-to-1 relationship. Therefore, the paintball feeders of the invention avoid any "ratchet effect" in feeding the paintballs to the paintball gun. Moreover, when there is an obstruction in the paintball feeder, due to, for example, a jam in, or blockage to, the infeed of the paintball gun (not shown), in the feed tube between the paintball feeder and the infeed of the paintball gun (not shown), or otherwise in exiting the feeder (not shown), the paintballs slip in relation to the movement of the rotating disk 530, allowing the obstruction to be cleared without breaking or jamming the paintballs in the paintball feeder. The rotating disk 530 in such situations will continue to rotate in its rotational path even though the paintballs are temporarily obstructed, without exerting a force on the paintballs which would exacerbate the obstruction, cause a jam in the feeder, or break the paintballs.

Optionally, but preferably, the rotating disk 530 includes several contact indentations or contact holes 540 formed in, and preferably passing through, the rotating disk's surface. The contact holes 540 are typically arrayed in a circular pattern around the edge of the rotating disk 530 over the drive channel 529. Other modifications to the rotating disk 530 made to assist the rotating disk in urging paintballs through the drive channel 529 can also or alternatively be used. For example, indentations 541 or a textured surface 542 and/or vertical attachments 544 (e.g., whisker-like or finger-like projections attached to, or formed on, the interior surface of the rotating disk) can be alternatively and/or additionally used (see, e.g., FIG. 9A). Any other suitable type of compliant contacts can also or alternatively be attached to or formed in the moveable component (e.g., first rotating disk) of the invention to aid the movement of paintballs through the paintball feeder.

In aspects where the rotating disk 530 includes one or more contact holes 540, the contact indentations or holes 540, are capable of engaging the ends of the paintballs 5, when they are positioned within, or in contact with, the contact holes 540. However, due to the small size of the contact holes 540 in relation to the diameter of the paintballs 5, and the thinness of the rotating disk 530, the indentations or contact holes 540 only temporarily engage the paintballs 5 and assist in urging them through the drive channel 529 toward the exit 570. Therefore, the paintballs are allowed to move somewhat freely between the contact holes or indentations 540 as they are urged primarily by engagement with the holes and secondarily by the frictional engagement of the rotating disk 530 through the drive channel 529. Thus, as can be seen in FIG. 7, for example, in a first exemplary contact hole 543, no paintball is present at all, whereas at a different position in the feeder 500, a paintball 547 is in contact with, and transiting between two contact holes 545 and 546, which assist the movement of the rotating disk 530 in urging the paintball 5 through the drive channel 529 to, and into, the outlet channel 565.

When the paintball 5 reaches a release point 557, and enters the outlet channel 565, the paintball is released from contact with the first rotating disk 530. The paintball enters the outlet channel 565, and the succession of the paintballs entering the outlet channel 565 drives the paintballs through the exit 570 and into the second feed tube 580, which connects the paintball feeder to the infeed of the gun. The paintball generally is released when it contacts the internal wall of the outlet channel 565, which prevents the paintball from continuing to follow the circular path of the rotating disk 530. Alternatively and preferably, the paintball feeder can further include a separate diverter plate (not shown) which directs paintballs into the exit and subsequently to the second feed tube 580. The diverter plate may consist of any suitable barrier which directs the paintballs to the exit of a feeder and prevents continued travel of the paintballs through the drive tube. For example, a paintball feeder which includes a casing formed of two or more components, can include a diverter plate held between and/or within the bound components which form the casing. Such aspects may allow for easier construction of paintball feeders.

Figure 8:
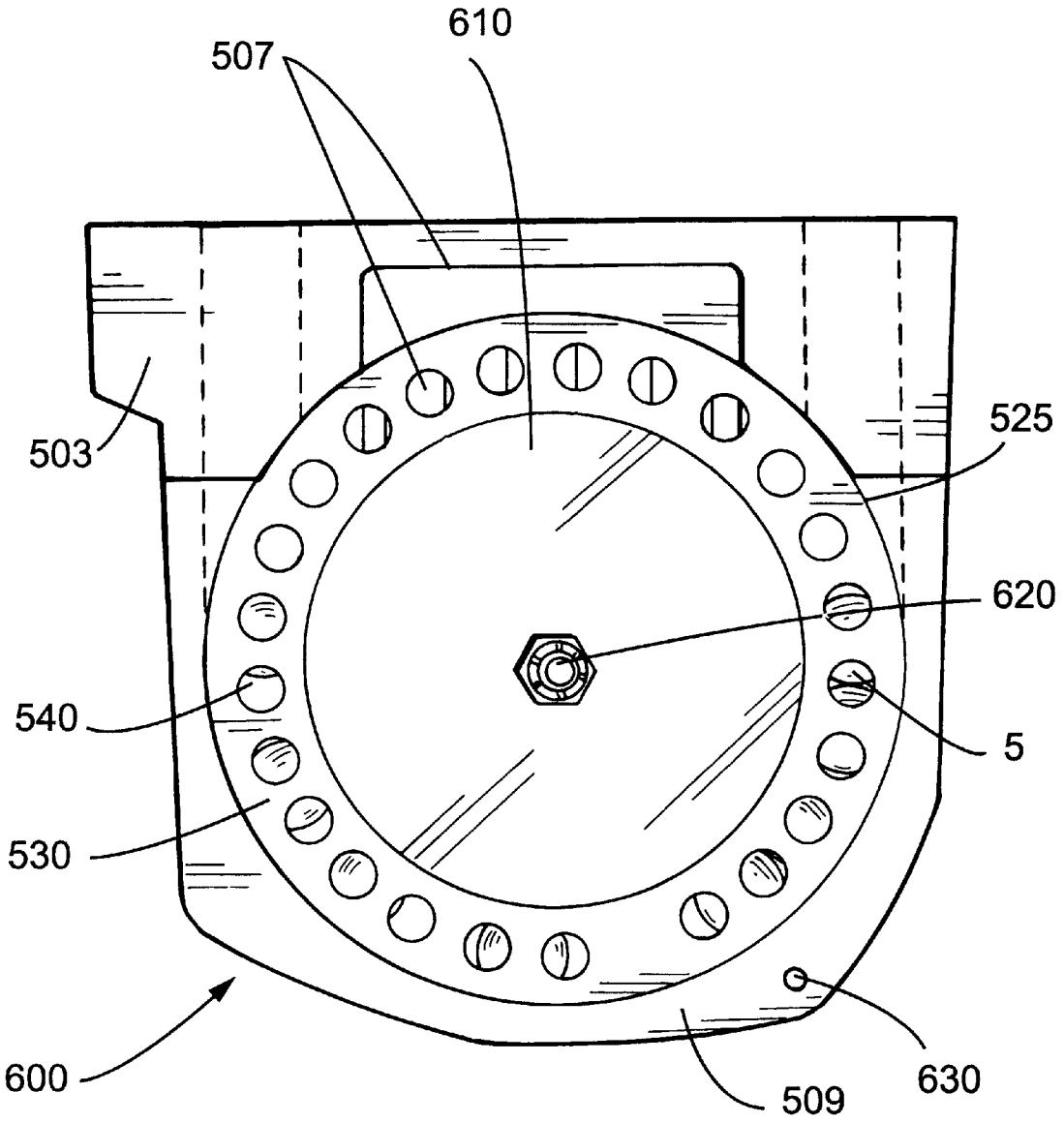
FIG. 8 is a side view of the rotating disk feeder of FIG. 7.

An external side view of the paintball feeder is shown in FIG. 8. The paintball feeder 500 includes a generally unshaped casing 503, which includes a partially hollowed out center portion and body portion 507, which is positioned therein. The body portion 507 supports the rotating disk assembly of the paintball feeder which is connected to the platform (interior supporting portion of support barrier not shown). The rotating disk assembly includes the rotating disk 530, which is engaged by a support disk 610. The support disk 610 is composed of a rigid material, such as polyethylene. The support disk 610 is held in contact with the rotating disk 530, by a standard nut and bolt assembly 620, which also connects the rotating disk 530 and support disk 610 to the body portion 507. The support disk can be any suitable size. Typically, the support disk 610 will be less wide than the rotating disk 530. The support disk 610 can also be of any suitable thickness. Typically, the support disk 610 will be about 0.125 to about 0.25 in. thick, more preferably about 0.15 to about 0.22 in. thick. The diameter of the support disk 620 may be varied to adjust the force on the paintball during feeding. Preferably, the feeder can accommodate support disks of various diameters to modify the force applied to the paintball by the rotating disk 530.

As also shown in FIG. 7, the feeder 500 includes several contact holes 540, which are formed in, and are circularly spaced around, the outer portion of the rotating disk 530, above the drive channel (not shown in FIG. 8), and have similar characteristics to those described above. As indicated above, paintballs 5 are urged by contact with the contact holes 540, but are not maintained in any given contact hole upon contact, and will typically be contacted by (i.e., transmit between) more than one contact hole 540 during passage of paintballs through the drive channel.

Figure 9:
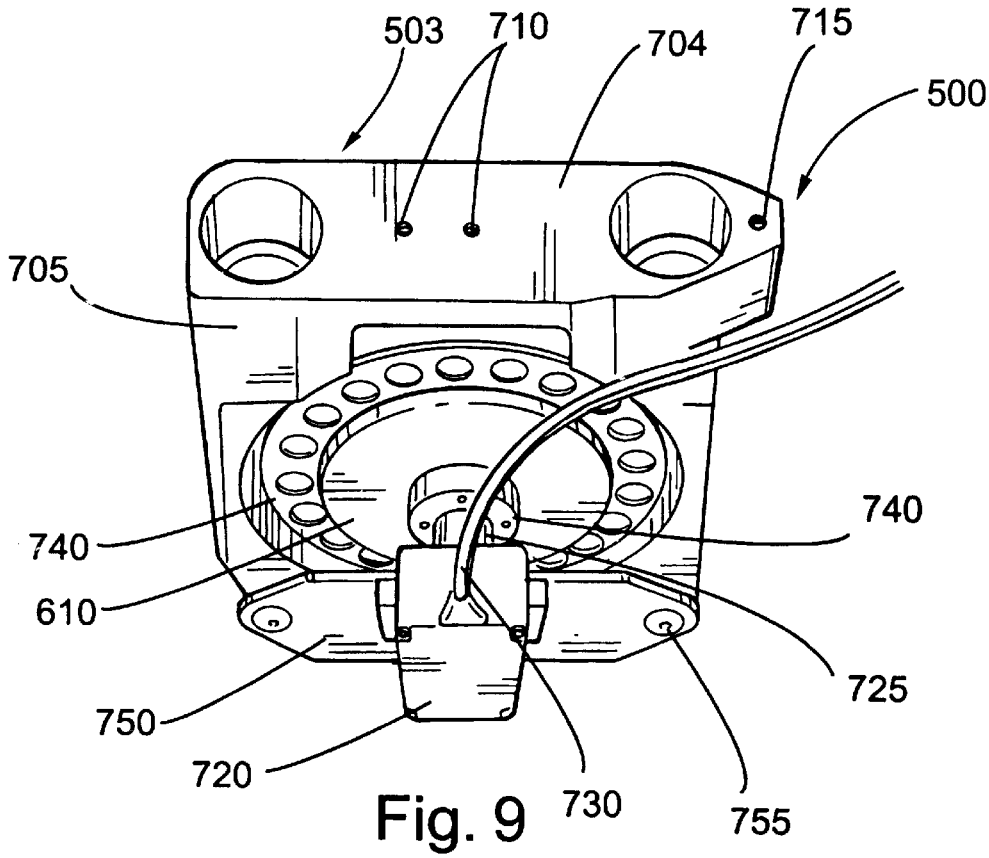
FIG. 9 is a perspective top view of one side of the rotating disk feeder of FIG. 7.
Figure 9A:
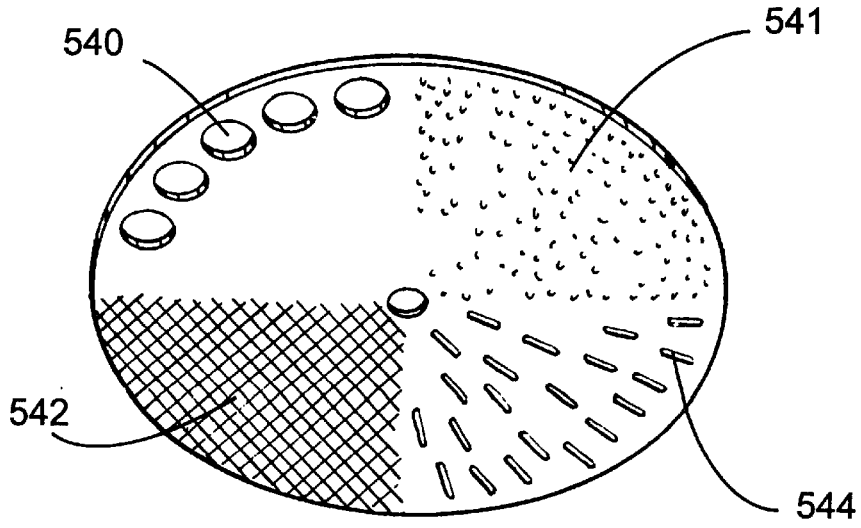
FIG. 9A is a perspective top view of a rotating disk, divided into quadrants, each quadrant showing an exemplary type of compliant contacts.

Through another external view provided in FIG. 9, an attachment section of the casing 503 of the feeder 500 can be seen. The attachment section, generally labeled 704, is typically attached to the paintball gun assembly (not shown). The section 704 can be any suitable size, but is typically wider than the rest of the casing 503, to permit the feeder 500 to be bound to and/or support other components of the gun assembly. Any suitable type of attachment can be used. As shown, the attachment section 704 includes two threaded central attachment passageways 710, and a threaded side peripheral attachment passageway 715, for receiving bolts (not shown) which are used to attach the feeder 500 to the paintball gun assembly (not shown).

The feeder 500, as seen in FIG. 9, further includes a standard DC motor 720, which is connected by a current-carrying wire 730 to a battery (not shown). The motor 720 is connected to a rotating drive shaft 725 which is further connected to a drive shaft ring 740 which is attached to the support disk 610 by shaft-supporting bolts (not shown) threaded through passageways 745 positioned in the drive shaft ring 740 and in the support disk. Preferably, the motor 720 can selectively operate the drive shaft 725 in both clockwise and counterclockwise orientation, to further prevent jams and allow easy unloading of the paintball gun's feed system. The motor 720 is rested on a support platform 750, which is further connected to the feeder casing 503 by support connectors 755.

Figure 10A:
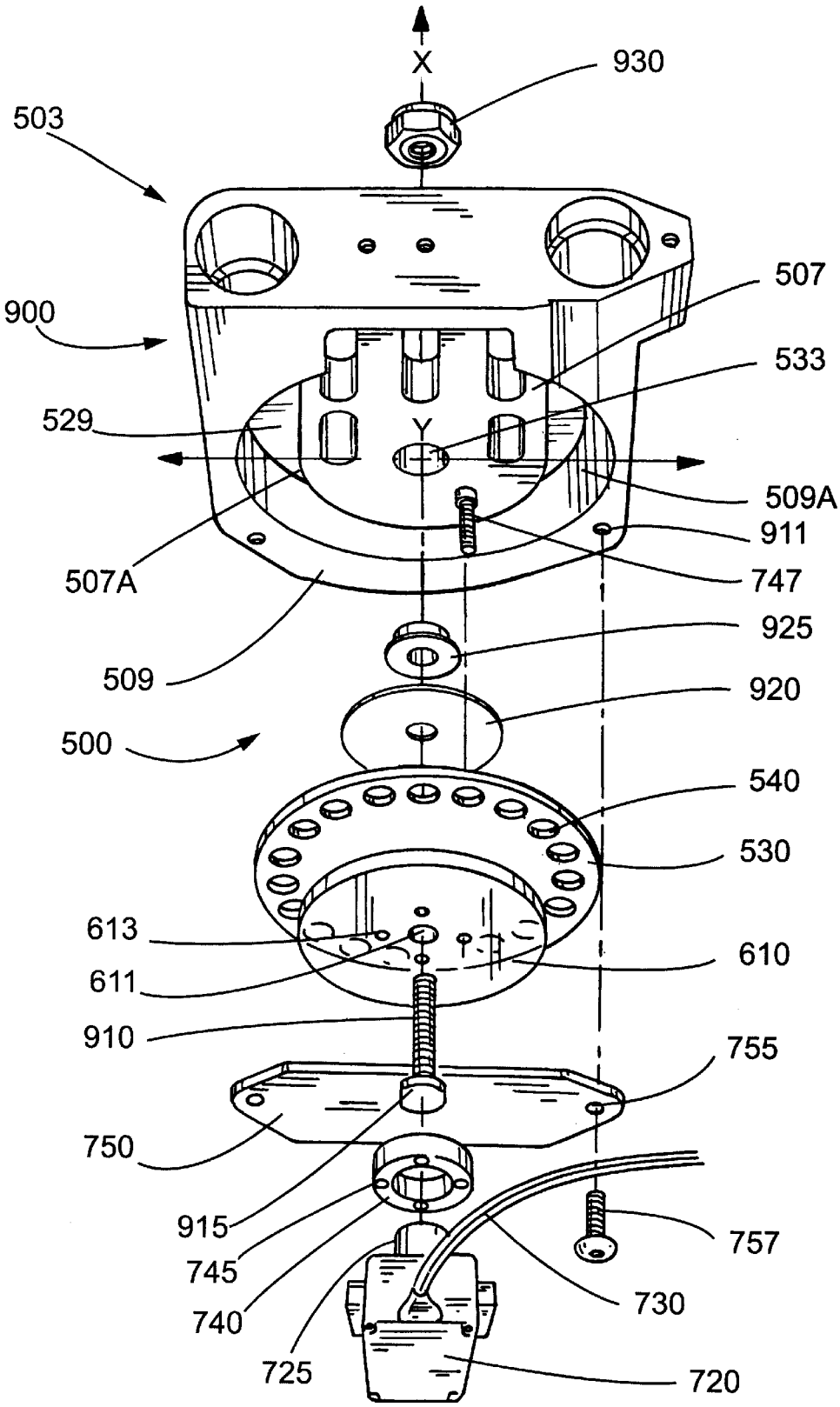
FIG. 10A is an exploded view of the rotating disk feeder of FIG. 7.

An exploded view of the apparatus shown in FIG. 9 is set forth in FIG. 10A. The components of the feeder 500 are assembled on the body portion 507 around a center point 933 through which a passageway 533 for receiving a bracing bolt 910 is formed. Similar passageways pass through the center of the support disk 611 and rotating disk 530. The bracing bolt 910 passes through the passageways of the support disk 610, rotating disk 530, and first washer 920 and first hub 925, which separate the rotating disk 530 from direct contact with the body portion 507, and into the body portion 507. The first hub 925 fits within a circular groove formed around the inside of the center point 933 of the body portion 907. On the other side of the body portion 507, the end of the bracing bolt 910 engages a threaded nut 930 thereby securing the assembled components to the bottom side of the casing's body portion 507. On its opposite end, the bracing bolt 910 secures the outside of the support disk 610 by its head 915, which has a larger diameter than the passageway 611 in the support disk through which the bracing bolt 910 is fed.

In assembly of the paintball feeder 900, the components are aligned on axis X above the central passageway 533. As previously mentioned, the bracing bolt 910 is passed through the passageways (e.g., 611) of the support disk 610, the rotating disk 530, the body portion 507, and, if present, first washer 920 and first hub 925. The threaded nut 930 is then used to engage the bracing bolt 910, thereby bracing the components in a relatively fixed vertical position to each other, while still allowing the braced components to rotate around central horizontal axis Y.

Preferably, the contact holes 540 of the rotating disk 530 are positioned in such orientation above the drive channel 529, the bottom of which 523 is formed by the inner side of the casing, and the sides of which are formed by the inside 509A of the side wall 509 and the outside edge 507A of the body portion 507. In this orientation, paintballs in the drive channel are engaged by the inner surface of the rotating disk 530 and indentations or contact holes 540 in urging the paintballs through the drive channel during operation of the feeder.

The support disk 610 includes four peripheral openings 613 for receiving shaft-supporting bolts (e.g., 747), which are threaded through the support disk 610 and into the drive shaft ring 740. The drive shaft ring 740 is mated to the drive shaft 725 which is connected to, or formed as a component of, the DC motor 720. The motor 720 is rested upon the support platform 750, which is connected to the outside of the unshaped side wall 509, such that the portion of the motor 720 which contains, or is attached to, the drive shaft 725, is positioned above the central passageway 533 of the body portion. The support platform 750 is mounted to the side wall 509 by support-bracing bolts 757, which are fed through threaded passageways 755 in the support platform 750 and into threaded holes 911 formed in the side walls.

In operation of the feeder 500, the motor 720, which is connected through a current-transmitting wire 730 to a power source, such as a DC battery (not shown) is selectively operated to rotate the drive shaft 725 and connected drive shaft ring 740, which through the shaft-supporting bolts 747 imparts rotational movement to the support disk 610. Due to the binding of the components by the bracing bolt 910, the rotation of the support disk 610 causes the entire rotating disk assembly to rotate in concert with the drive shaft.

Figure 10B:
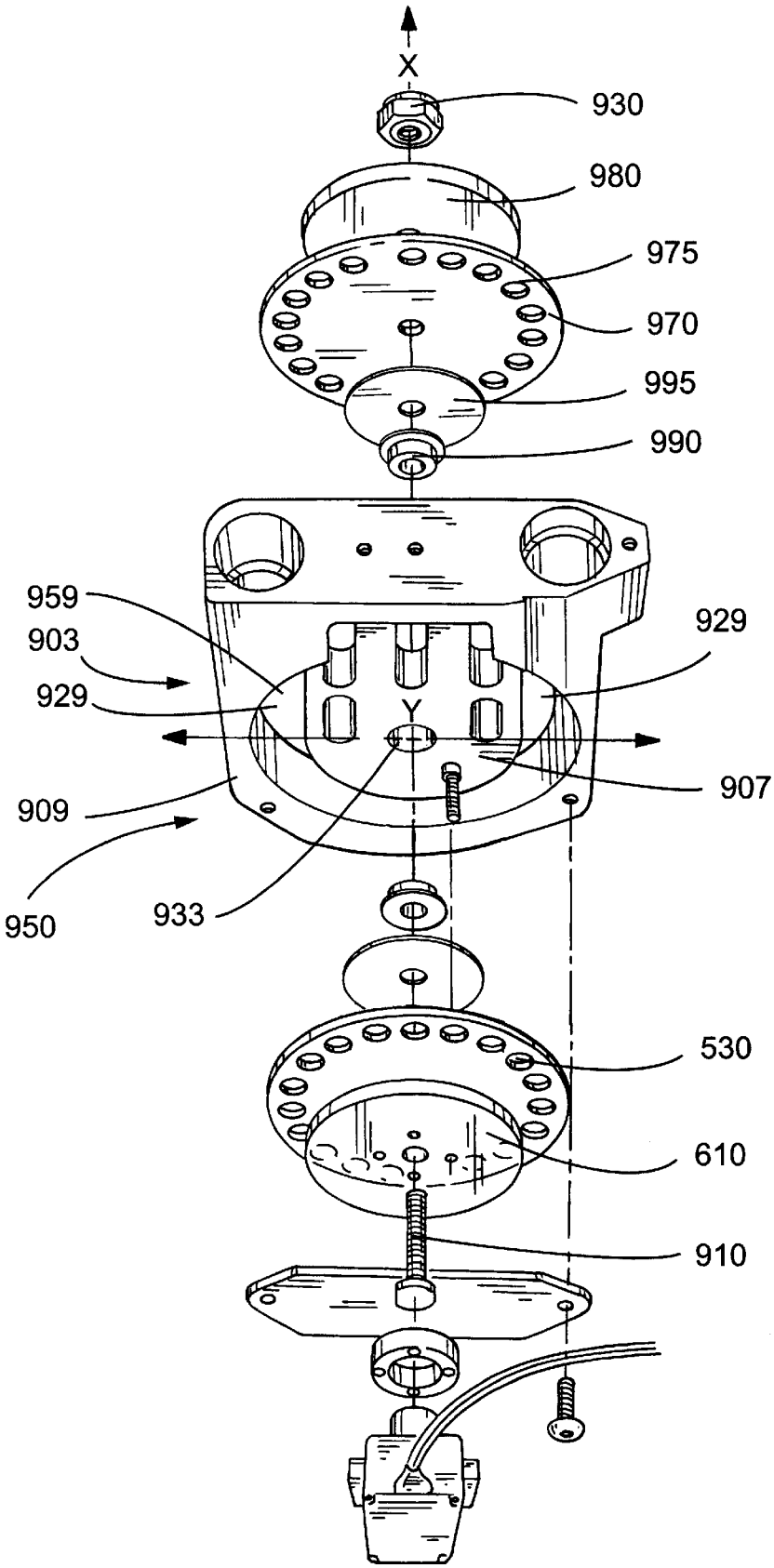
FIG. 10B is an exploded view of an alternative embodiment of the feeder of the invention which includes two rotating disks.

An exploded view of an alternative and preferred type of paintball feeder, similar to that shown in FIG. 10A, which incorporates a second rotating disk and support disk in the rotating disk assembly, is shown in FIG. 10B. In such aspects, the paintball feeder, generally labeled 950, includes a center space 959 formed within a casing 903, surrounded by a side wall 909, which forms a drive channel 929. A support platform 907, which is connected to, or optionally and preferably integrally formed with, the casing 903, protrudes into a hollow portion 959. The support platform 907 is preferably of less thickness than the side wall 909, such that when the components of the apparatus are assembled, the combined thickness of the assembled components and support platform 907 is equal to or less than that of the side wall 909. This ensures that the interior of the side wall 909 effectively forms one side of the drive channel 929, and also protects the exposed components of the rotating disk assembly from damage due to side impact.

In addition to the rotating disk 530 and support disk 610, the rotating disk assembly of the apparatus 950 further includes (1) a second rotating disk 970, containing contact holes 975, which is preferably of similar size, shape, and composition as the rotating disk 530, and (2) a second support disk 980, which is also preferably similar in size, shape, and composition to the support disk 610. Thus, the second rotating disk in such aspects replaces the walls and opposing side of the drive channel formed in the casing in above-described feeders Optionally and preferably, first washer and first hub, 920 and 925, respectively, are included, as discussed above, as well as second hub and second washer, 990 and 995, respectively, which are positioned in a similar orientation with respect to the second rotating disk 970 and support platform 907. The washers and hubs when incorporated reduce unwanted friction between the rotating disks and the support platform and thus aid in the effective operation of the paintball feeder and aid in the durability of the rotating disks by eliminating contact between the compliant disks and the more rigid casing.

Preferably, as discussed above, the components of such apparatuses can be replaced to adjust the performance aspects of the feeder. In such aspects, the adjustment of the size and stiffniess of the support disks used in the apparatus and/or the pressure placed on the support disk and first rotating disk by adjusting the contact between the threaded nut and bracing screw, the pressure imparted by the rotating disk and second rotating disk on paintballs can be adjusted.

Figure 11:
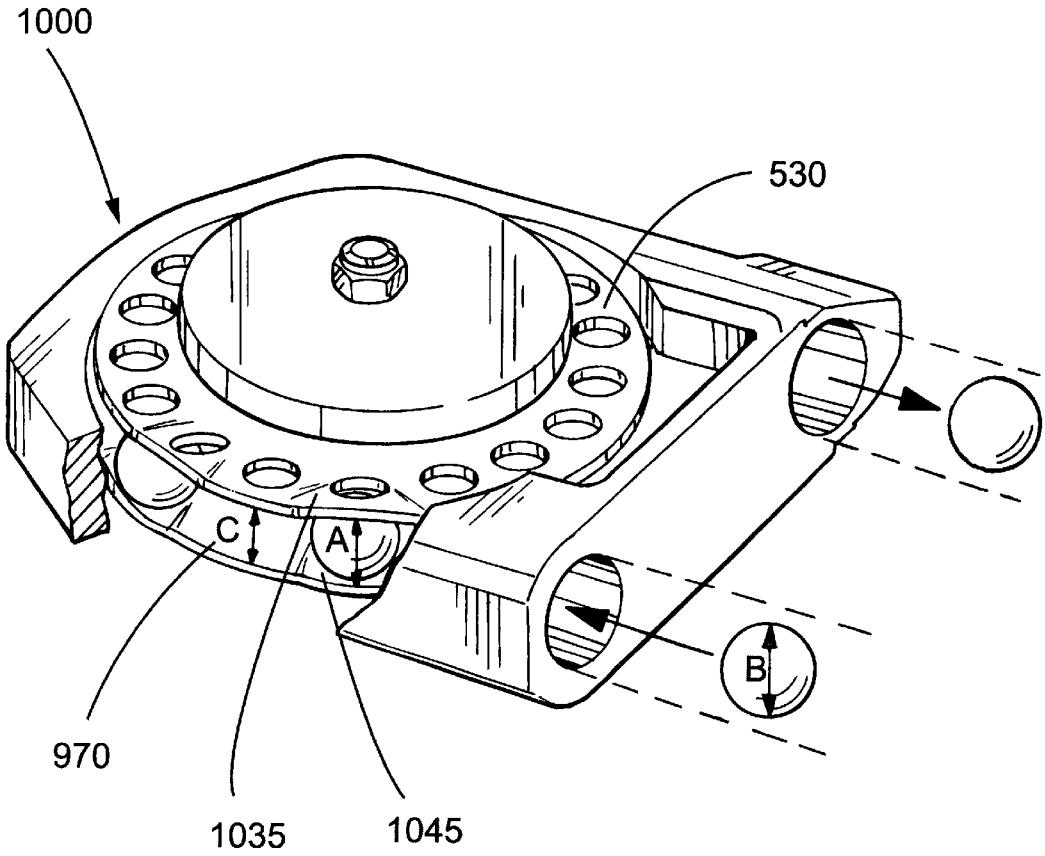
FIG. 11 is a side partial cutaway view of the feeder of FIG. 10.
Figure 11:
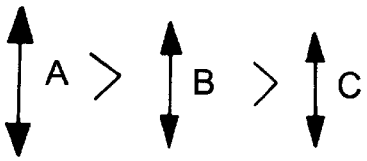

A side view of the assembled paintball feeder of FIG. 10B, with partial cutaway in the side wall, is shown in FIG. 11, which is useful for describing the operation of such devices. In operation of the feeder 950, a paintball 5 is fed to entrance of the feeder and through the inlet channel (not shown) to the contact point with the rotating disk 530 and second rotating disk 970. Preferably, as discussed above, both disks are made of materials compliant to the paintballs used in the device, and thus yield to the paintball upon contact allowing the paintball to be frictionally engaged between them. Where the paintball is engaged by the disks the distance A between the disks, formed by yielding of the first rotating disk 530 at an entrance point 1035 and second rotating disk 970 at an entrance point 1045, is greater than the distance C between the disks in their resting position. Any suitable distance between the disks can be used. Generally, the smaller the distance between the disks, the greater the pressure applied to the paintball, and one may modify the distance between the disks to adjust the pressure accordingly. Distance A, however, can be equal to, or only slightly smaller than, the diameter of the paintball B, which typically is slightly larger than the distance between the disks, as discussed further herein. So engaged by the two rotating disks, the paintball is ready to be urged by rotation of the disks to travel in a rotational path through the drive channel.

Figure 12A:
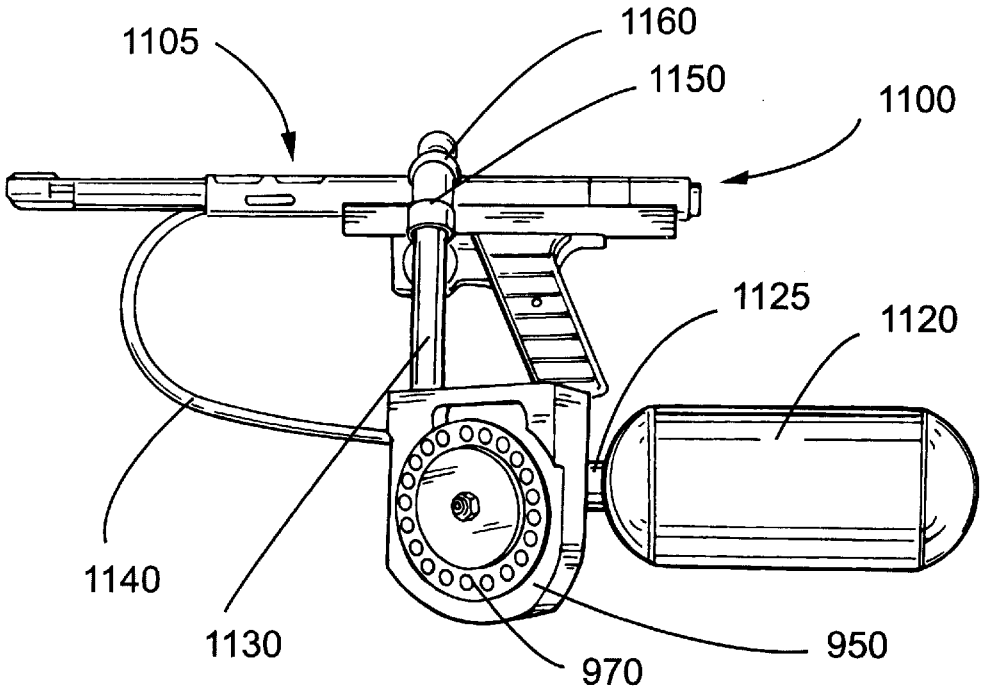
FIG. 12A is a side view of a paintball gun incorporating the rotating disk feeder of FIG. 10B.
Figure 12B:
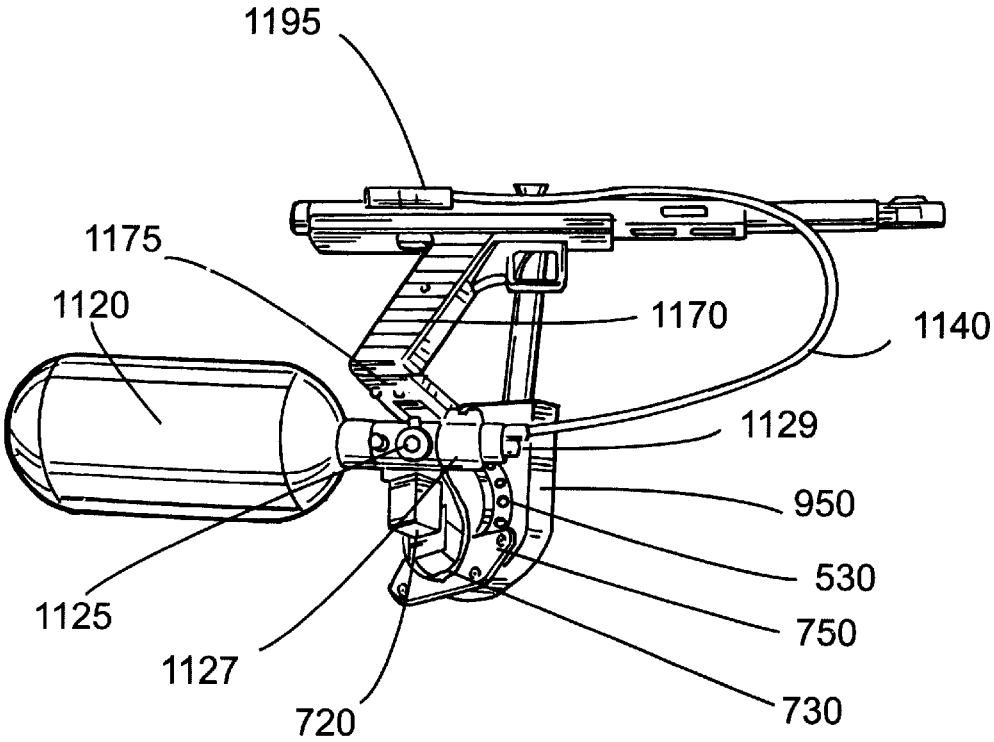
FIG. 12B is a side view of opposite side of the paintball gun and feeder shown in FIG. 12A.

Examples of paintball guns incorporating paintball feeders of the invention are shown in FIGS. 12A and 12B. As shown in FIG. 12A, in the paintball gun assembly 1100, the feeder 950 is attached to a semiautomatic paintball gun 1105 by a feed tube casing 1130 which serves to connect and hold the feeder 950 in relation to the gun 1105, and encases the second feed tube, through which paintballs are fed to the gun's infeed near the rear of the gun 1160. The feed tube casing 1130 can be made of any suitable rigid material for holding the feeder in position with relation to the gun, such as a rigid plastic or aluminum pipe. The feed tube casing 1130 is further held by an attachment ring 1150, which is fitted around the casing and sealed to the gun 1105. The feed tube within the casing can be formed of any suitable material for holding and transmitting paintballs. Thus, in some aspects a flexible material such as a flexible plastic or rubber tubing is desirable for use in forming the feed tube, while in other aspects rigid materials such as aluminum or polyethylene plastics are desirable.

The paintball gun assembly 1100 further includes a compressed gas storage tank 1120, which feeds compressed gas, such as $N_2$ to the gun through gas tubing 1140. The storage tank 1120 can be any suitable storage tank. Several types of storage tanks are well known in the art, and need not be discussed in detail here. Briefly, the compressed gas is fed through the gas tubing 1140 to the gun 1105, upstream of the infeed 1160, and drives the firing of the paintballs from the gun when in use.

The opposite side of the paintball gun shown in FIG. 12A is presented in FIG. 12B. As can be seen in this view, the feeder 950 is further attached to the gun's handle 1170 by handle attachment 1175, which is typically made of aluminum. The handle attachment 1175 typically is in the form of a flat aluminum attachment which is designed to engage a mount (not shown) located on the handle of paintball gun. Paintball gun handle mounts are commonly incorporated in paintball guns, and the handle attachment preferably is designed to be used with a mount provided with the paintball gun to which the paintball feeder is to be attached.

Another attachment is made between the feeder 950 and the storage tank 1120 around a tank ring 1127. Further elements of the compressed gas feed system of the paintball gun assembly can also be seen in this view such as the valve control 1125. Selectively operating the valve control allows the user to control the compressed gas feed through an orifice 1129, the gas tubing 1140, and subsequently to the compressed gas infeed 1195. Also positioned on this side of the paintball gun is the motor 720, positioned on its support platform 750, which selectively drives the compliant disks 530 and 970. As discussed above, the motor 720 is connected by a current-carrying wire 730 to a power source, such as a DC battery (not shown), which is also preferably contained within the paintball gun assembly.

Figure 13:
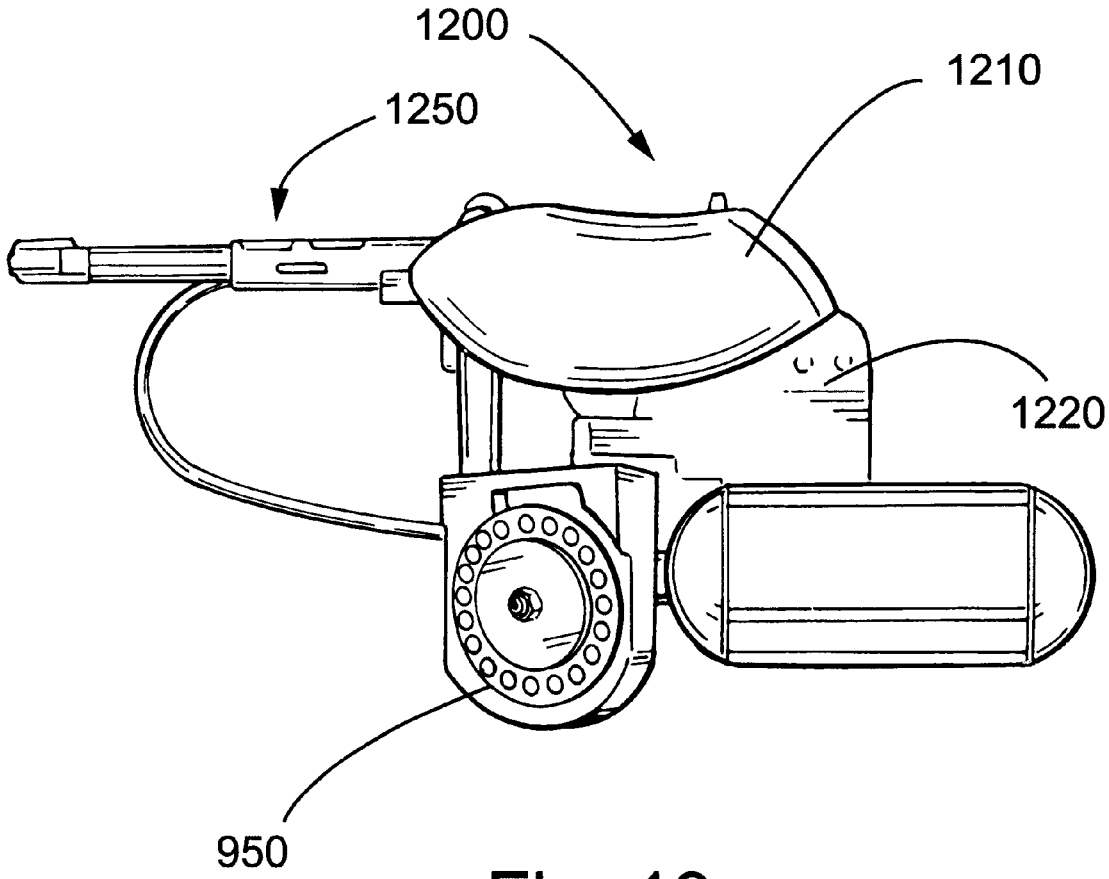
FIG. 13 is a side view of a paintball gun incorporating the rotating disk feeder of FIG. 10B, in connection with an attachable hopper.

An alternative paintball gun assembly 1200, is shown in FIG. 13. This aspect is substantially identical to the aspect shown in FIGS. 12A and 12B, with the addition of a hopper 1210 for storing paintballs prior to feeding to the paintball gun 1250. The gun assembly further includes a lower casing 1220, which contains the first feed tube (not shown), through which paintballs are fed from the hopper 1210 into the paintball feeder of the invention 950, as well as the electronic components of the paintball gun assembly (e.g., the battery or other power device)(not shown). Thus, in this aspect, as described above with regard to other hopper feeder aspects of the invention, the hopper assembly acts not only as a container for storage of the paintballs but also as a shield for the user, giving an advantage in reducing available body space during competition. The hopper 1210 can further contain one of the above-described in-container feeders of the invention also to avoid jams in the hopper.

Figure 14:
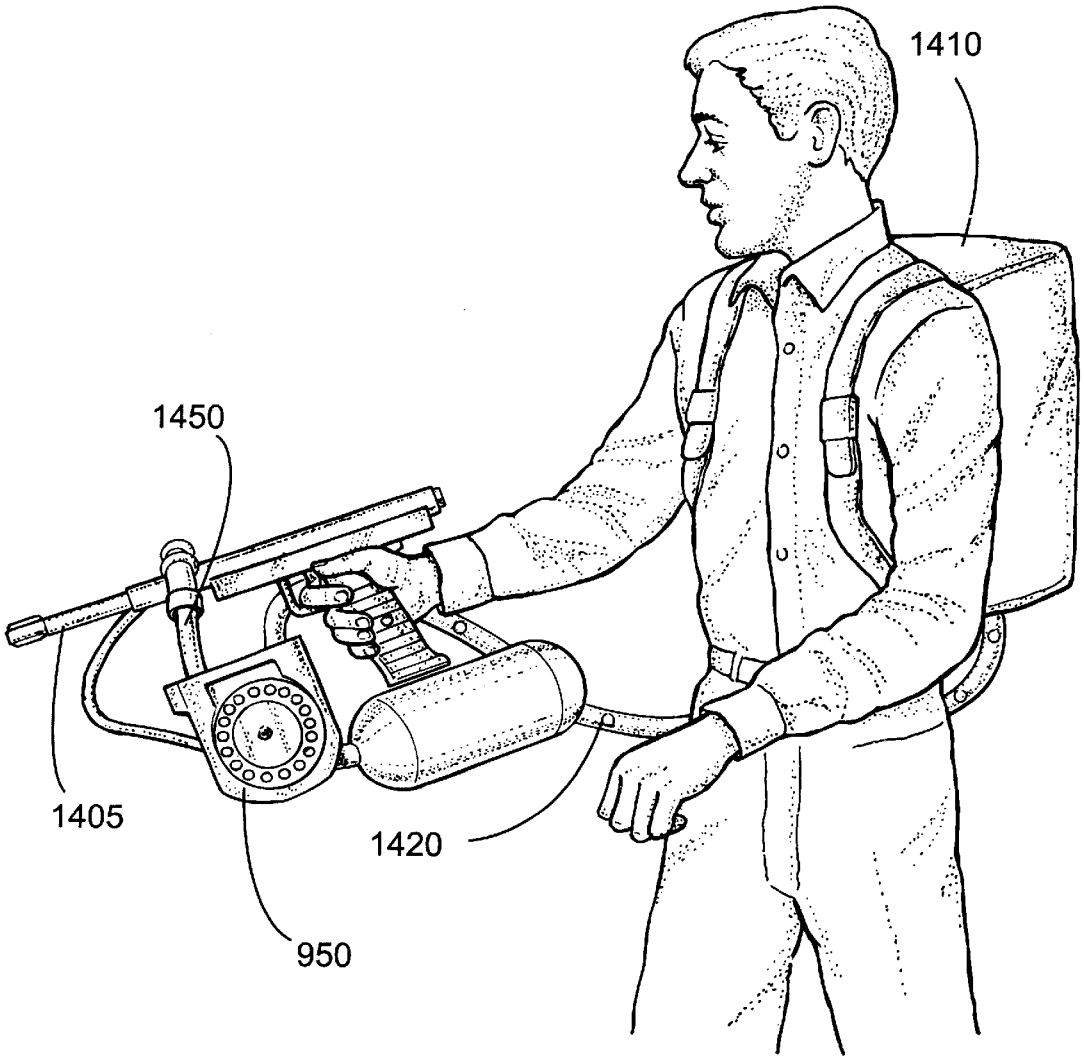
FIG. 14 is a view of the paintball gun and rotating disk feeder in FIG. 8 connected to a backpack container for paintballs and feed tube.

Another aspect of the invention which is advantageous for competition is shown in FIG. 14. In this aspect, the paintballs to be fed to the paintball gun 1405, are contained in a backpack container 1410 which is worn by the user. The paintballs in the backpack container 1410 are fed through the first feed tube 1420, either by gravity, or positive feed mechanisms such as a second paintball feeder according to the present invention, or a combination of gravity and positive feed, to a rotating disk paintball feeder 950 of the invention, which feeds the paintballs to the gun 1405. Such aspects provide the user with a convenient way of holding an increased amount of paintballs, and reducing weight of the paintball gun assembly which is held during competition.

In paintball gun systems where feed tubes are provided, the invention further provides a feed tube sensor, which detects the presence of a paintball in the feed tube(s) and which preferably is capable of sending a signal upon such detection to the motor(s) of the system and allowing for selective operation of the feeder(s) of the system in response to such a signal. The feed tube sensor can be any suitable sensor for detecting the presence of one or more paintballs in a portion, or all of, the feed tube. Examples of suitable sensors include optical sensors and mechanical sensors (e.g., a switch which is triggered when one or more paintballs are in a position in the feed tube). The inclusion of such sensors prevents breakage of paintballs which are misfed (e.g., incompletely fed) to the paintball gun's infeed. Moreover, such feeders when operated in concert with the paintball feeder(s) and paintball gun's firing system allow for more effective operation of the device, as the systems can be selectively operated when paintballs are or are not present in sufficient quantity in the feed tube. Sensors similar to the feed tube sensors can also or alternatively be incorporated in the paintball gun, such as in the infeed or firing chamber.

Figure 15:
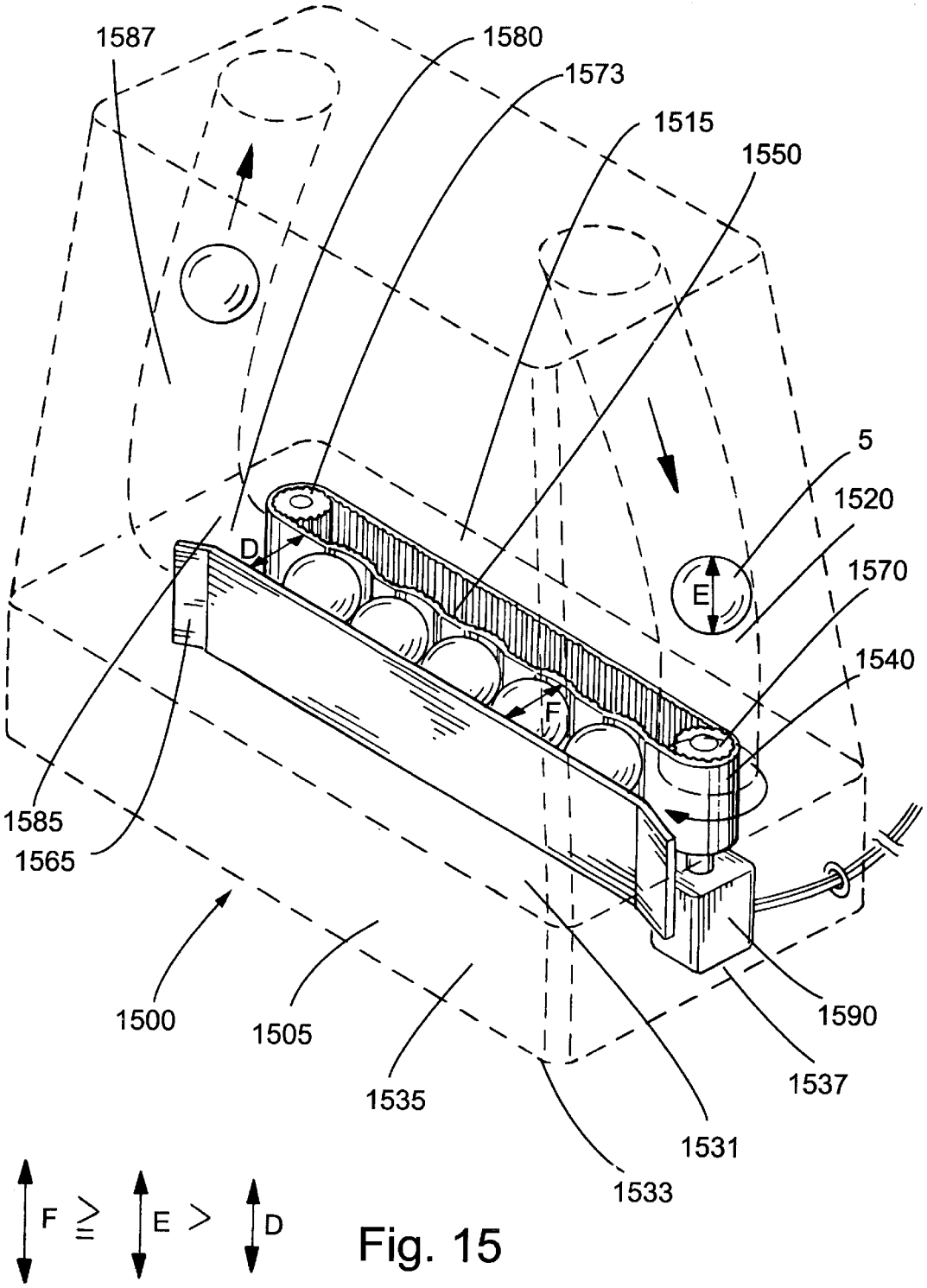
FIG. 15 is a perspective view of a conveyor feeder aspect of the invention, displaying the internal components of the feeder.

An alternative aspect of the invention which incorporates a compliant conveyor belt as the first moveable component of the invention, instead of a compliant rotating disk, is shown in FIG. 15. The feeder apparatus 1500 of this aspect includes a base 1515, including a top surface 1531, bottom surface 1533, walls 1535, and shorter side walls 1537. Within the base is a space in which a conveyor belt 1550 feeder is positioned, surrounded by the solid portions of the casing. The base 1515 is made of materials similar to those used in the feeder casings described above and is preferably formed to the base to be joined to the remainder of the feeder housing.

Paintballs 5, are fed through a feed tube 1520 into the base 1515, through an entrance 1540, which is formed by a tunnel passing through the base. The paintballs 5 are brought into contact with a conveyor belt 1550 and rigid contact wall 1565, which can either be a separately formed wall in the interior of the casing (as shown), or be formed of the edge of the solid portion of the casing. The contact wall can be formed of any suitable rigid material, including those used to form the casing.

The distance D between the conveyor belt 1550 and the contact wall 1565, is smaller than the diameter E of the paintballs 5 fed to the feeder apparatus 1500. The conveyor belt 1550, in such aspects, similar to the rotating disks described above, is formed of a material which is compliant to the paintballs fed into the feeder upon contact. Thus, the conveyor belt 1550, will yield to the paintball when it is brought into contact, thereby allowing the paintball to be held between the conveyor belt 1550 and contact wall 1565 and solid portion of the bottom surface 1533 of the casing. The space F where such paintballs are so engaged by the conveyor belt 1550 and contact wall 1565 will be equally to or slightly larger then diameter E.

The conveyor belt 1550 is driven by a drive wheel 1570, which is connected to and operably driven by a motor 1590, which is connected by a current carrying wire 1595 to a DC battery (not shown). In addition to being wound around and driven by the drive wheel 1570, the conveyor 1550 is also wound around a response wheel 1573, which rotates in response to the operation of the drive wheel 1570. Preferably, as described above, the operation of the motor 1590, and thus the drive wheel 1570 and conveyor 1550 is selectively controllable, more preferably in response to the firing of the paintball gun through use of a sensor/controller (not shown). In any event, the paintballs 5 held between the conveyor 1550 and the contact wall 1565 are urged through the feeder by the operation of the drive wheel and subsequent movement of the conveyor 1550. While the conveyor 1550 frictionally engages the paintballs 5, the paintballs are still permitted to slip in relation to the movement of the conveyor, due to the compliant nature of the material from which the conveyor 1550 is formed, and thus the paintballs 5 are not moved through the feeder in a "ratchet effect" manner. Thus, when paintballs are temporarily obstructed in or between the paintball feeder and the paintball gun, for any of the reasons mentioned above, the conveyor belt, due to its compliant nature, will continue to move past the paintballs stuck in the feeder without causing damage to the paintballs, exacerbating the obstruction, or otherwise jamming paintballs in the feeder. Preferably, as also described above, the conveyor 1550 can be driven in either a clockwise or counterclockwise direction.

When the paintballs 5 have been fed through almost the entire length of the conveyor belt 1550, the contact wall 1565 flares away from the conveyor belt 1565 at a release area, immediately adjacent to an exit 1580, through which the paintballs are fed by the motion of the conveyor belt 1550. After passing through the exit 1580, the paintballs 5 pass into the second feed tube 1587, and then pass to the infeed of the paintball gun (not shown).

Figure 16A:
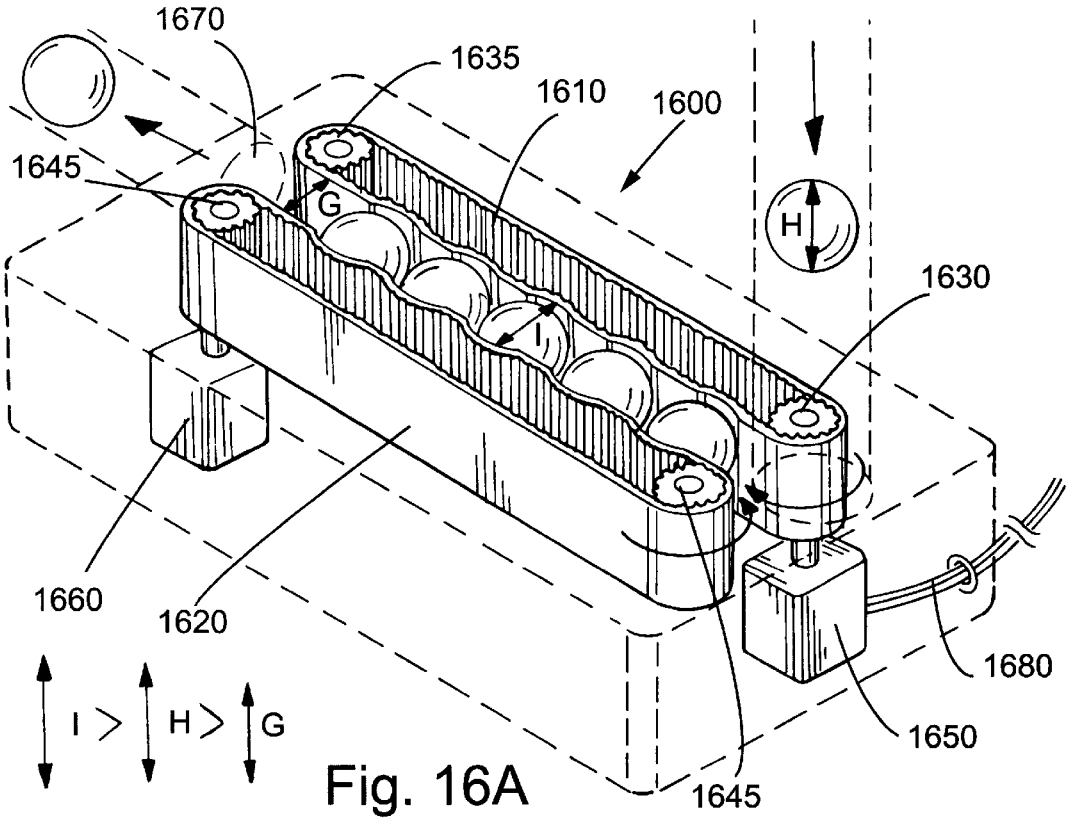
FIG. 16A is a perspective view of an alternate conveyor feeder aspect, which includes two compliant conveyors, displaying the feeder's internal components.

Additional alterations of such compliant conveyor feeders are possible within the present invention. For example, a feeder apparatus 1600, as shown in FIG. 16A, may include a first compliant conveyor belt 1610 and a second compliant conveyor belt 1620, rather than a single conveyor belt and a contact wall. Similar to the above-described aspects, the distance G between the first conveyor 1610 and second conveyor 1620, when no paintball is engaged between them is smaller than the diameter H of the paintballs fed to the feeder. Thus, in such an aspect, the paintball is brought into contact with the first conveyor 1610 and second conveyor 1620, which both yield to the paintball and frictionally engage the paintball between them. In places where the conveyor belts yield to a paintball, the distance between the belts (see, e.g., point I) is about equal to or slightly larger than the diameter of the paintball H.

The first conveyor 1610 is wrapped around a first drive wheel 1630 and first response wheel 1635. Similarly, the second conveyor 1620 also is wrapped around a second drive wheel 1640 and second response wheel 1645. The first drive wheel 1630 and second drive wheel 1640 are connected to a first and second motor, 1650 and 1660, respectively. These motors can be connected to their own power source (not shown), or can be driven by a single power source, for example by attachment of a current containing wire 1680 to a DC battery (not shown). The motion of the drive wheels rotates the conveyor belts in opposite directions to facilitate the movement of the paintball through the feeder.

Once engaged by the first and second conveyors, the motion of one or both conveyors urges the paintball through the feeder while permitting slippage relative to the movement of the conveyors. The conveyors continue to urge the paintball through the feeder in such a fashion until reaching the exit 1670, where the length of the conveyors end and the paintball is released.

Figure 16B:
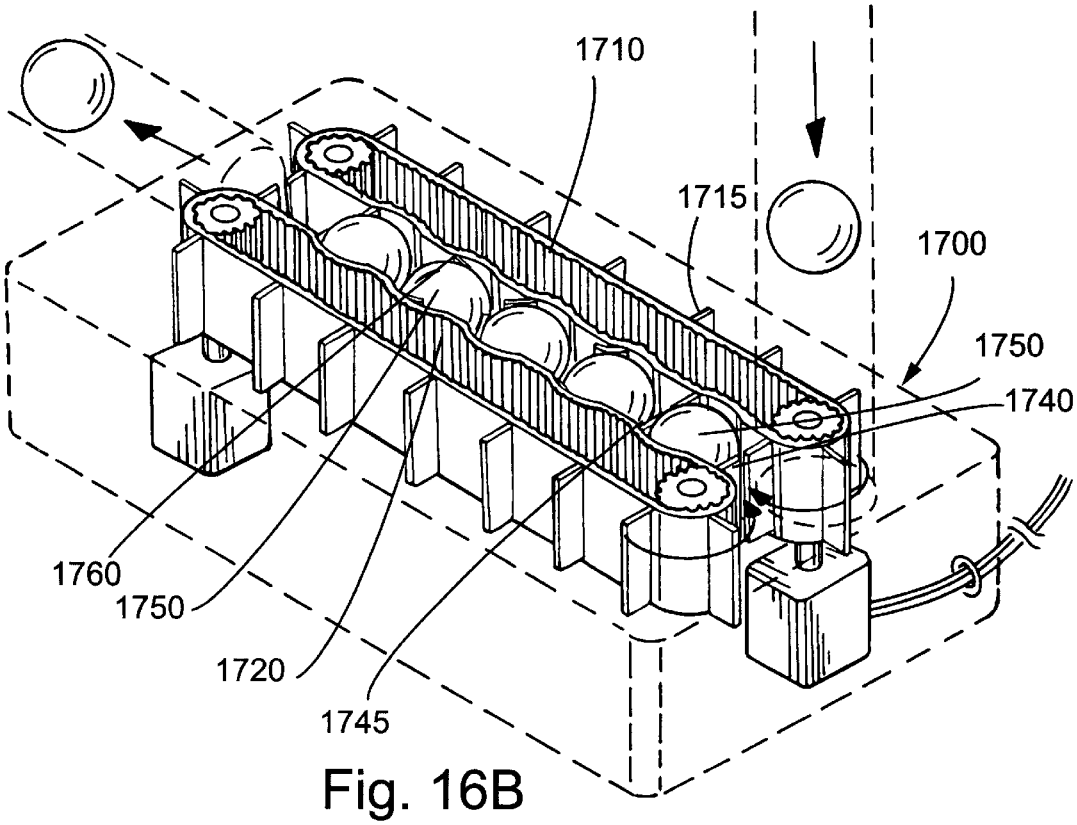
FIG. 16B is a perspective view of a second alternate conveyor feeder aspect, displaying the feeder's internal components.

A further modification of such aspects of the invention is shown in FIG. 16B. A first compliant belt 1710 and second compliant conveyor belt 1720, as described above, are provided. However, the first conveyor belt 1710 is fit with compliant contacts, such as a compliant conveyor paddle, 1715, which is attached to the first conveyor 1710. Other contact surfaces, such as whisker-like attachments or other raised surface features may be used. The compliant conveyor paddle 1715 extends across some portion of the channel between the first and second conveyor belts, through which the paintballs are fed, but typically does not touch the surface of the second conveyor belt 1720. The paddle may extend across a small amount of the channel (for instance 5–10%) up to nearly across the entire channel (for instance, 90–95%).

The compliant conveyor paddles 1715 are preferably made of a material compliant to the paintball which is engaged between the first and second conveyor belts, as to permit slippage between the conveyor paddles while assisting the urging motion of the conveyor belts. For example, a first paintball 1750 is held in position between a first 1740 and second 1745 of compliant conveyor paddles, which move with the operation of the first conveyor belt 1710. In contrast, a second paintball 1750 downstream of the first paintball 1740, passes through one of the compliant conveyor paddles 1760, which yields to the paintball based upon the force applied by the paintball on it in either direction.

As stated above, numerous combinations of the disclosed aspects of the invention are possible and the ordinary skilled artisan will be readily able to make such combinations to develop unique paintball feeder systems. For example, a system which combines a hopper feeder aspect and one of the paintball feeders of the invention is possible. A cross sectional view of such a system, wherein a hopper storing a quantity of paintballs having hopper feeder positioned within it is directly attached to a paintball feeder is shown in FIG. 17.

Figure 17:
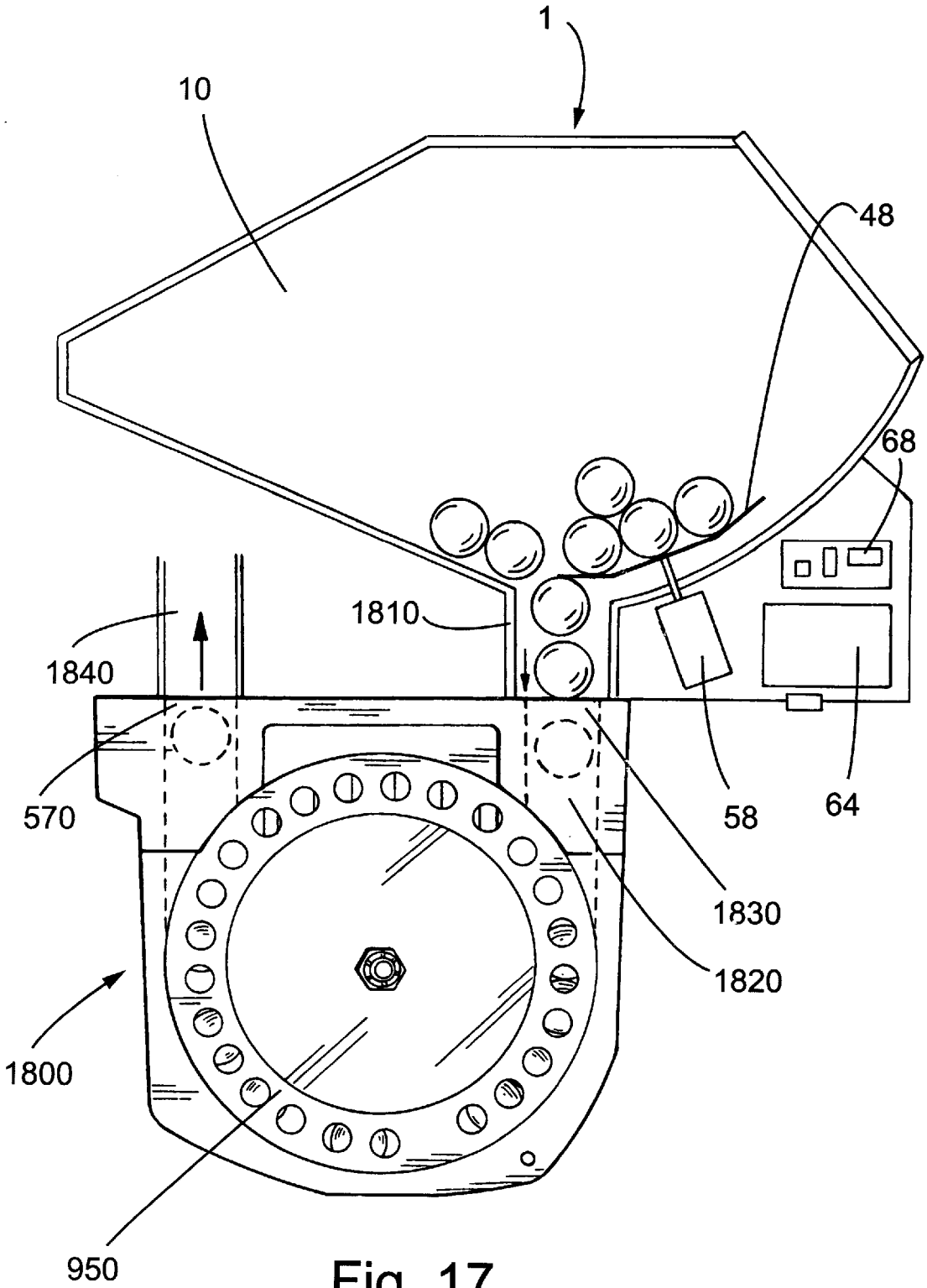
FIG. 17 is a cross sectional view of a paintball feeder system of the invention including a paintball hopper directly connected to a rotating disk paintball feeder.

In the paintball feeder system 1800 shown in FIG. 17, a hopper feeder system 1, as described above, is included. The hopper feeder 1 includes a conventional hopper 10 for storing a number of paintballs. Positioned within the hopper 10 is a jam free paintball feeder using an agitator paddle 48, connected to a DC motor which is operably connected to a sensor/controller and DC battery, as described above. Paintballs are gravitationally fed in such a system through the exit of the hopper 1810 to the inlet channel 1820 of the paintball feeder 950, through a transition 1830 where the feeder 950 and the hopper 10 are mated. Fed in this manner to the paintball feeder 1875, the paintballs are subsequently urged through the feeder by rotation of the rotating disk through to the paintball feeder's exit, and typically through a feed tube to the infeed of the attached paintball gun (not shown). Of course, other variations on such combinations are possible (e.g., using a conveyor feeder in the hopper and/or in the paintball feeder).

Another embodiment of the paintball feeder of the present invention will now be described with reference to FIGS. 19A–19D. According to this embodiment the paintball feeder, generally labeled 1900, includes a two-piece housing having a first shell 1902 and a second shell 1904. The first and second shells 1902 and 1904 can be constructed of any suitable material. In one embodiment, they are constructed of durable plastic from a single mold. Preferably the user can see through the housing. The feeder 1900 also includes a feed mechanism, generally labeled 1906, for transporting paintballs through the feeder 1900, a drive assembly, generally labeled 1946, for actuating the feed mechanism 1906, a motor 1949 for driving the drive assembly 1946, and a power source 1948 for providing power to the motor 1949. The first shell 1902 and second shell 1904 are kept in contact with one another with body bolts 1988 (FIGS. 19A–19D).

Figure 19A:
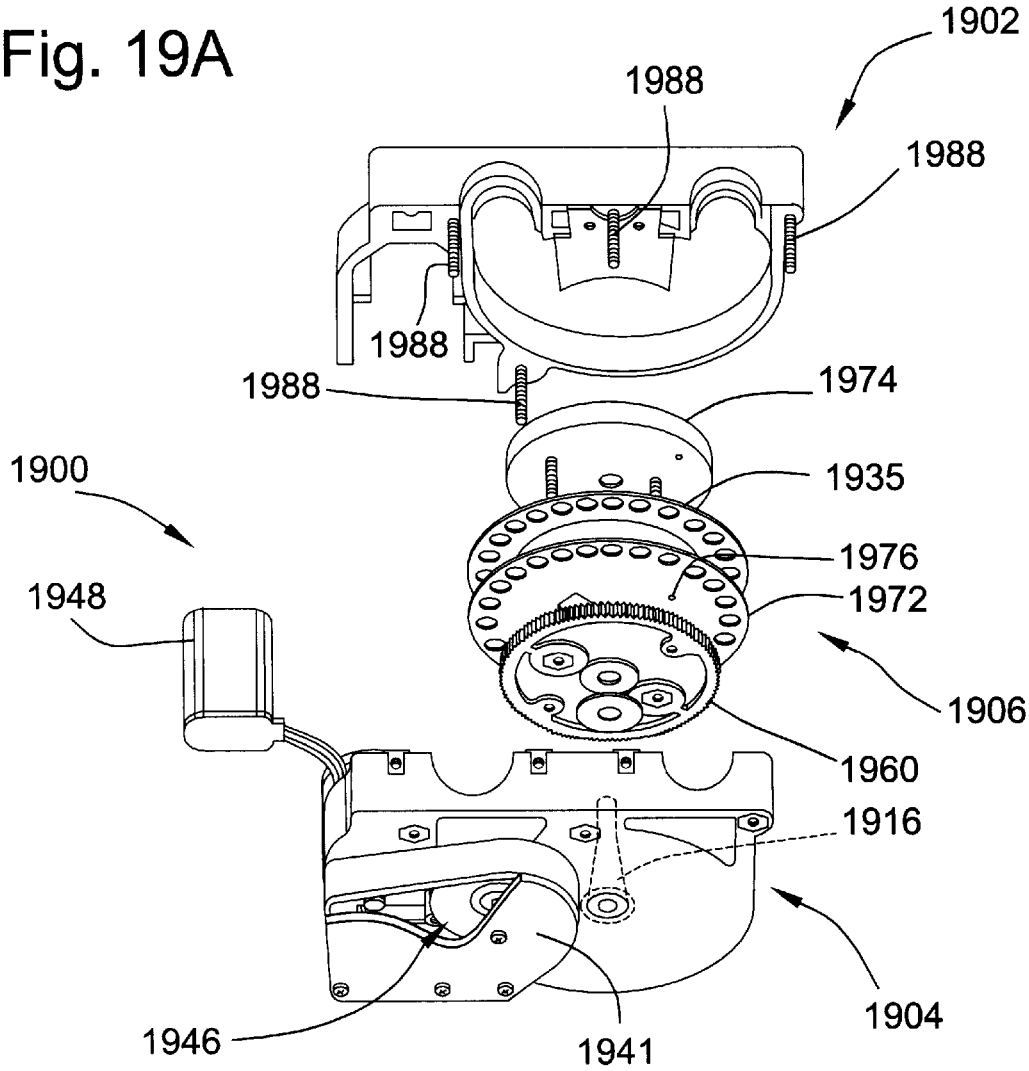
FIGS. 19A–D are exploded views of the rotating disk feeder of FIG. 18.
Figure 19B:
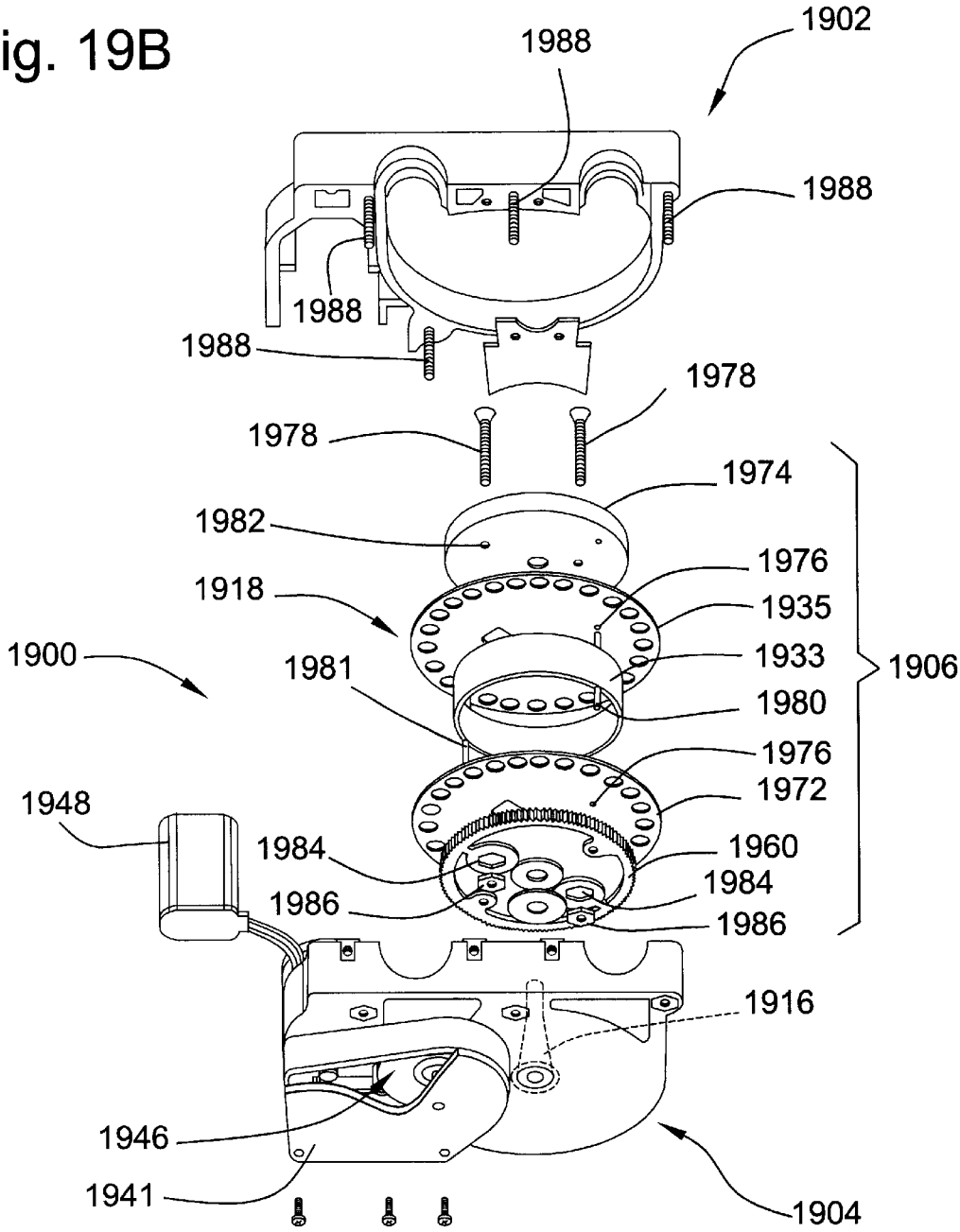
Figure 19C:
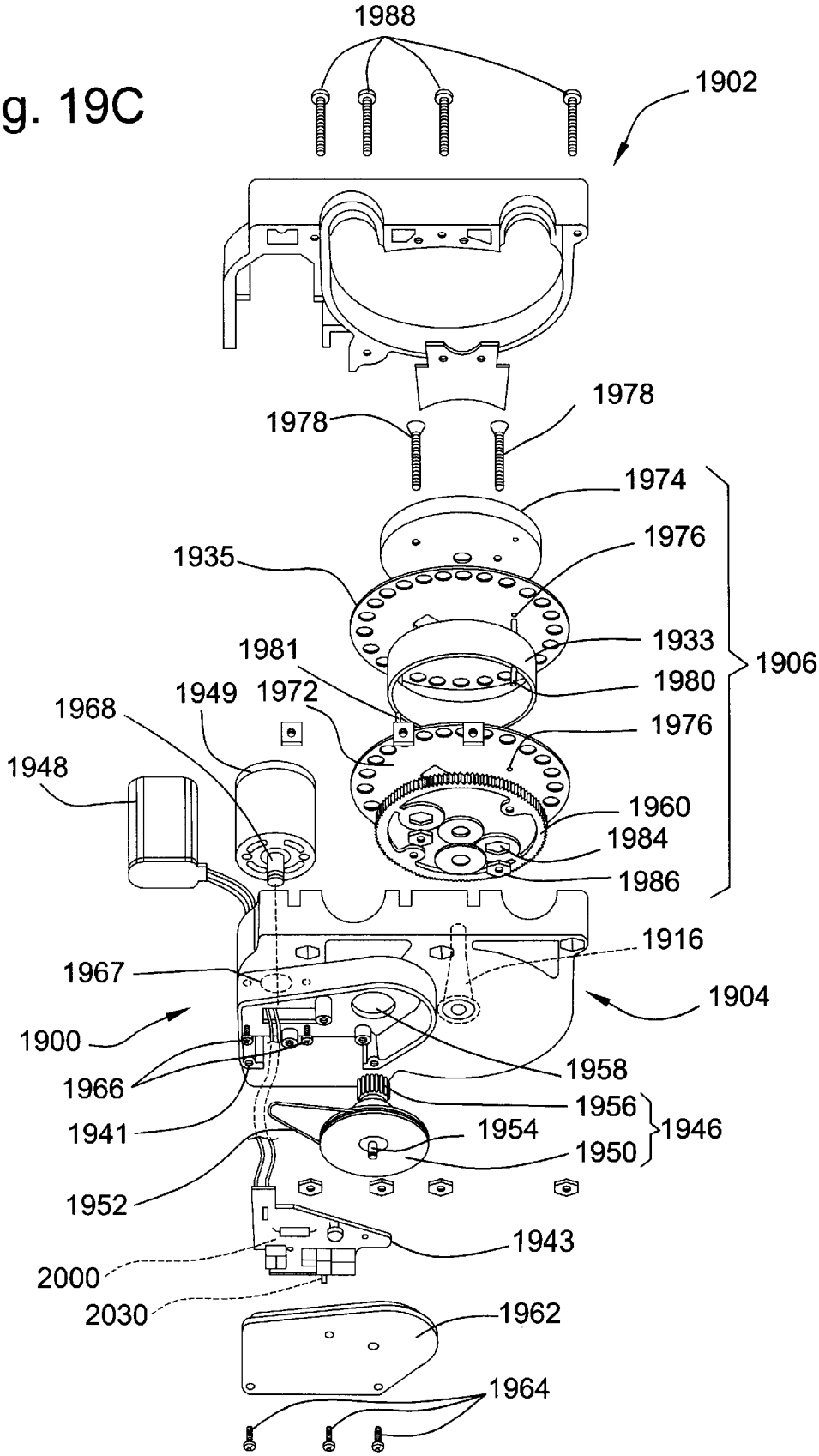
Figure 19D:
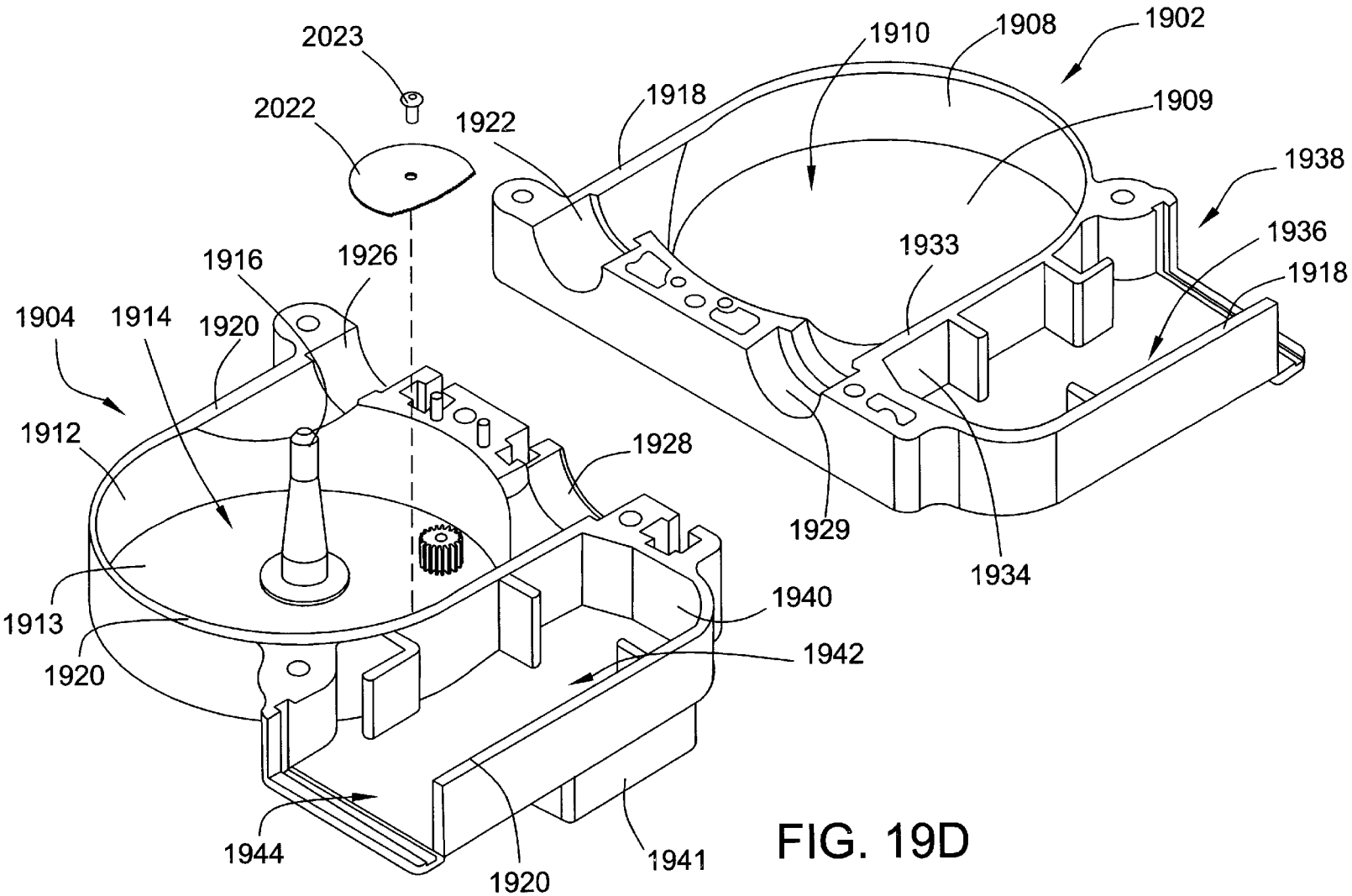

As shown in FIG. 19D, the first shell 1902 has a generally cylindrical inner wall 1908 and a generally circular base surface 1909 that define a cavity 1910. Similarly the second shell 1904 has a generally cylindrical inner wall 1912 and a generally circular base surface 1913 that define a cavity 1914. The second shell 1904 also includes a spindle 1916 extending from the base surface 1913. An integral sensor 2022 may be coupled to surface 1914 using an suitable means. In the example shown, sensor 2022 is coupled to the surface 1914 using a rivet 2023. The first and second shells 1902 and 1904 have cooperating surfaces 1918 and 1920. A portion of the cooperating surface 1918 of the first shell 1902 forms the top of the generally cylindrical wall 1908 of the first shell 1902 while a portion of the cooperating surface 1920 forms the top of the generally cylindrical wall 1912 of the second shell 1904.

Referring again to FIG. 19D, the first shell 1902 also has a first generally semi-circular groove 1922 and a second generally semi-circular groove 1924. Similarly, the second shell 1904 has a first generally semi-circular groove 1926 and a second generally semi-circular groove 1928. The second shell 1904 also includes a drive compartment 1941 for holding the drive assembly 1946.

When the feeder 1900 is in an assembled configuration, the feed mechanism 1906 (FIGS. 19A–19D) is rotatably disposed on the spindle 1916, and the first and second cooperating surfaces 1918 and 1920 of the first and second shells 1902 and 1904 are in substantial contact with one another. Also the first generally semi-circular groove 1922 of the first shell 1902 and the first generally semi-circular 1926 of the second shell 1904 form an inlet channel (shown with reference numeral 1930 in FIG. 18). Furthermore, the second generally semi-circular groove 1924 of the first shell 1902 and the second generally semi-circular groove 1928 of the second shell 1904 form an outlet channel (shown with reference numeral 1932 in FIG. 20).

Referring again to FIG. 19D, the first shell 1902 includes a side wall 1934 that forms three sides of a generally rectangular cavity 1936 having an open end 1938. Similarly, the second shell 1904 also includes a side wall 1940 that forms three sides of a generally rectangular cavity 1942 having an open end 1944. A portion of each of the respective cooperating surfaces 1918 and 1920 form the top of a portion of each of the respective side walls 1934 and 1940 of the first and second shells 1902 and 1904. When the feeder 1900 is in an assembled configuration, the generally rectangular cavities 1936 and 1942 of the first and second shells 1902 and 1904 form a chamber for holding the drive assembly 1946 and the power source 1948 (FIGS. 19A–19C).

Referring again to FIGS. 19A–19C, the feed mechanism 1906 will now be described in greater detail. The feed mechanism 1906 includes a disk spacer 1933, a first rotating disk 1935, a second rotating disk 1972, a support disk 1974 and a second drive component 1960. The first and second rotating disks and support disk are constructed as previously described in connection with FIG. 7. The second drive component 1960 is designed to engage to the first drive component such that rotation of the first drive component results in like rotation of the second drive component. Preferably both the first and second drive component form reciprocal gears. The disk spacer 1933 is generally constructed as a hollow cylinder and is interposed between the first and second rotating disk such that holes 1976 in each rotating disk are positioned over guide rods 1980 and 1981. The guide rods 1980 and 1981 are secured to opposite ends of the disk spacer 1933 to facilitate mounting of the feed mechanism components such that they are properly aligned. The support disk 1974 and second drive component 1960 are mounted to the outside of the first rotating disk 1935 and second rotating disk 1972, respectively. Support bolts 1978 are inserted through holes 1982 in the support disk 1974, further through openings in the first rotating disk 1936, disk spacer 1934 and second rotating disk 1972, through openings in the second drive component 1960. Support bolt nuts 1986 are used to engage the support bolts 1978 and secure the components into a single feed mechanism. Preferably, openings 1984 in the second drive component 1960 include a modeled portion to match the configuration of the support bolt nuts 1986 so that they can be locked into place. The guides 1980 and 1981 and support bolts 1978 ensure that the components of the feed mechanism 1906 rotate in concert.

The drive assembly 1946 will now be described in greater detail, with reference to FIG. 19C. The drive assembly 1946 includes a drive wheel 1950. The drive wheel 1950 includes a groove on its outer edge for frictionally engaging a belt 1952. A drive shaft 1954 with a proximal end and a distal end fits through the drive wheel 1950 such that the proximal end is fixed to the drive wheel 1950. The distal end of the drive shaft 1954 is connected to a first drive component 1956. In the embodiment shown, the first drive component 1956 is a gear. Alternatively, the drive wheel 1950 and first drive component 1956 can be constructed of a single integral component. The drive wheel 1950 rests in drive control chamber 1941 and the first drive component 1956 is passes through an opening 1958 in the second shell 1904 such that it engages a second drive component 1960. An optional control circuit 1943 can also be mounted in the drive compartment 1941. A cover 1962 is used to enclose the components of the drive assembly 1946. The cover 1962 can be attached using any suitable method. Preferably, the cover is secured to the second body portion 1940 using screws 1964 so that it can be removed for access to the indirect drive mechanism components.

Referring again to FIG. 19C, the motor 1949 is mounted within the cavity 1942 (FIG. 19D) of the second shell 1904, preferably using screws 1966, such that a motor shaft 1968 of the motor 1949 extends into the drive compartment 1941 through a hole 1967. The motor shaft 1968 includes a groove on its end portion for frictionally engaging the belt 1952. Alternatively, the motor shaft 1968 can incorporate a separate drive wheel for engaging belt 1952. The motor 1949 may be of any suitable type, however, it is preferably a DC motor such that it can be powered by a DC power source such as a battery. The power source 1948, which may be a battery, may provide power to the motor 1949 through the optional control circuit 1943 to selectively operate the motor 1949.

When the motor 1949 is provided with suitable power, for example from the control circuit 1943 and power source 1922, the motor drive shaft 1968 rotates. The rotation of the motor shaft 1968 causes rotation of drive wheel 1950 and first drive component 1956, due to the fact that the drive wheel 1950 and motor shaft 1968 are both frictionally engaged to belt 1952. The rotation of the first drive component 1956 further imparts rotation to the second drive component 1960 thereby causing rotation of the feed mechanism 1906. The embodiment shown in FIGS. 19A–19D advantageously allows the motor 1949, circuit 1943 and power source 1948 to be mounted within the paintball feeder 1900.

Figure 18:
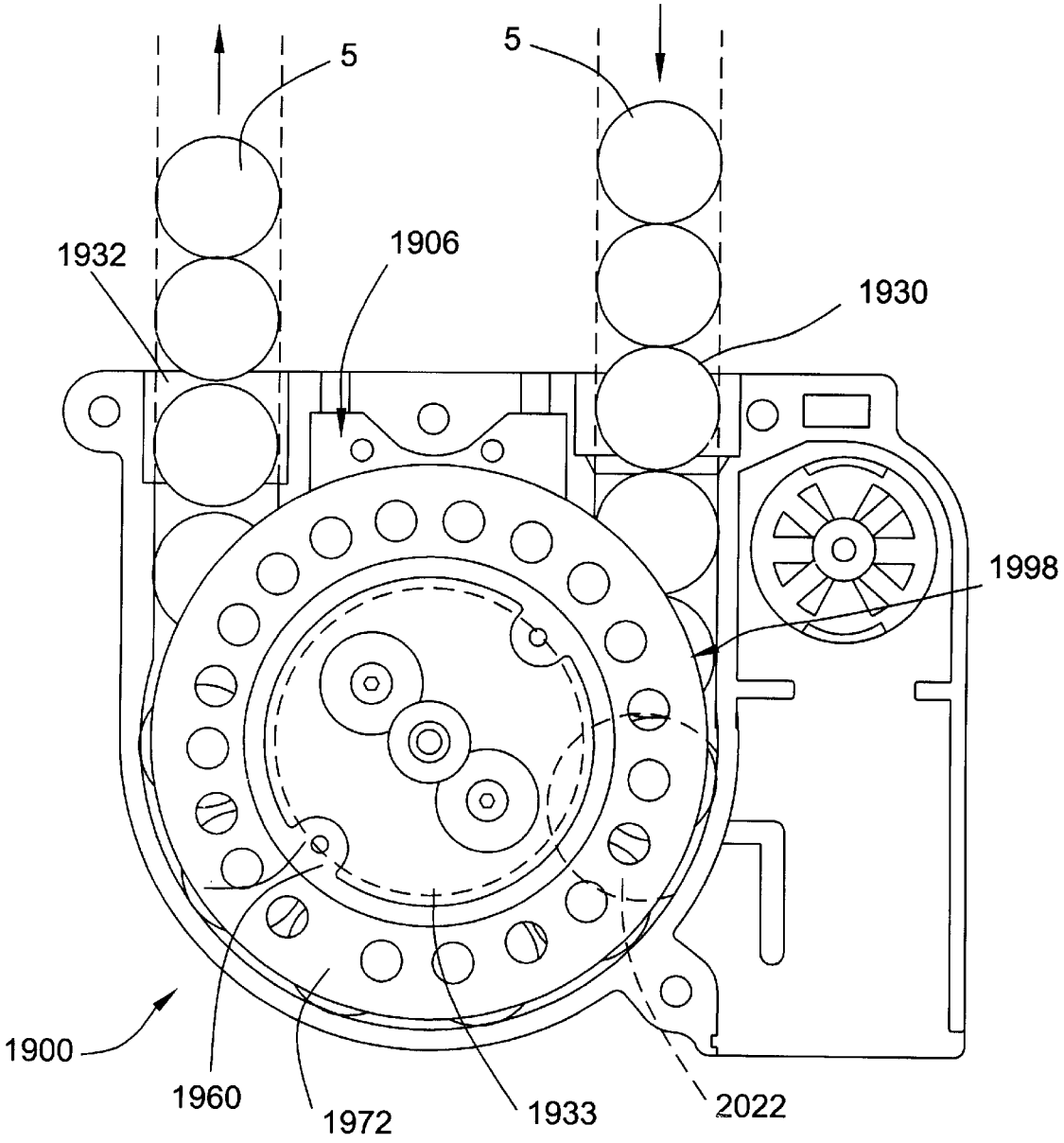
FIG. 18 is a side view of alternative embodiment of the rotating disk feeder of FIG. 7.

Turning now to FIG. 18, an example of how the feeder 1900 of FIGS. 19A–19D operates will now be described. Paintballs 5 enter the feeder 1900 through the inlet channel 1930. When the feed mechanism 1906 rotates in response to activation of the motor 1949, the paintballs 5 are frictionally engaged by the first rotating disk 1936 and the second rotating disk 1972 in a contact area 1998. This nature of this frictional engagement is the same as that described for the embodiment of FIG. 7. The paintballs 5 are then carried through the feeder 1900 by the rotating disks to the outlet channel 1932 where they are pushed out of the feeder 1900 and to the paintball gun (not shown). Preferably, the motor 1949 is energized for relatively short discrete periods of time such that paintballs 5 are fed into the paintball gun one at a time.

Figure 20:
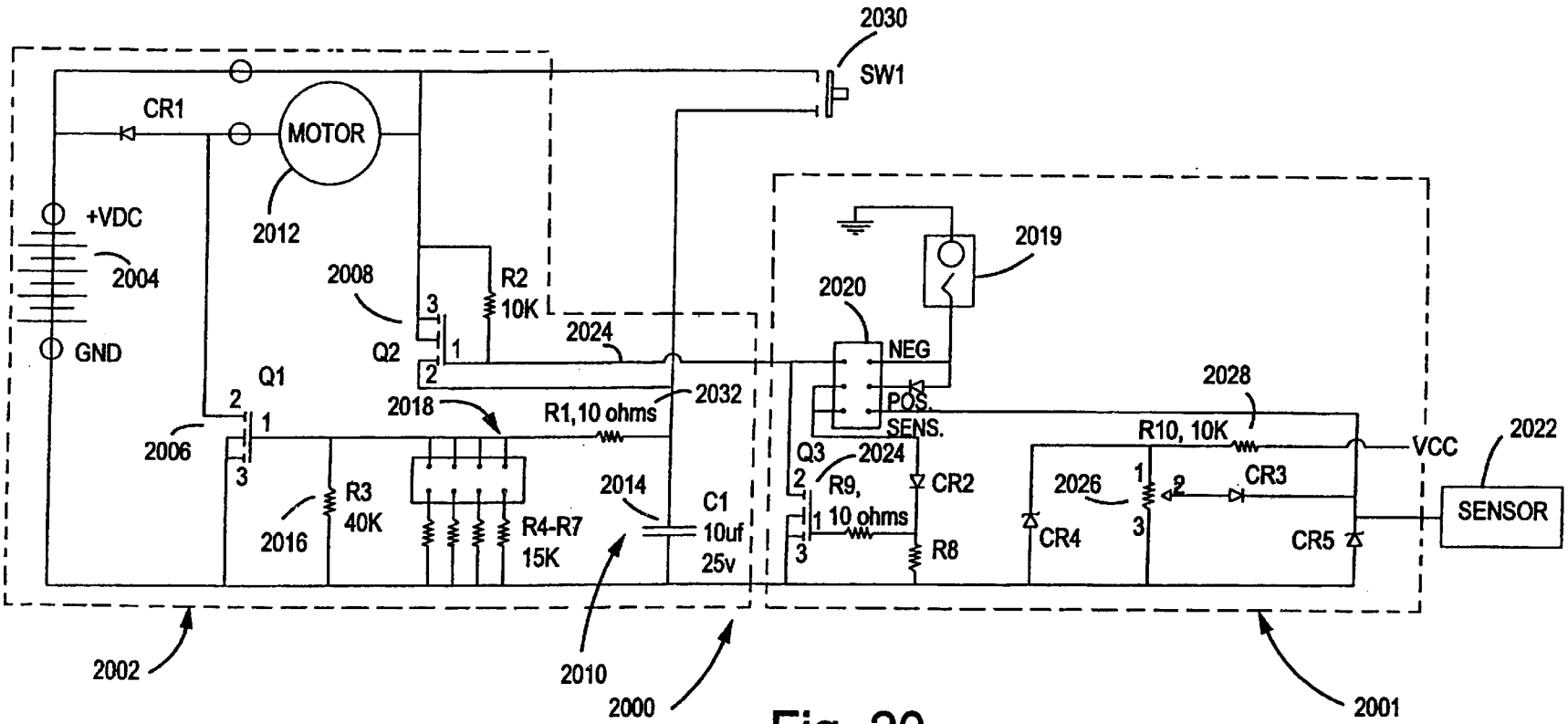
FIG. 20 is a schematic of a control circuit that may be used in an embodiment of the invention.

FIG. 20 shows an example of a control circuit that can be used with the feeder apparatuses of the present invention. The control circuit, generally labeled 2000 includes a sensor interface section 2001 and a motor drive section 2002. The sensor interface section 2001 connects to a sensor and provides a signal to the motor drive section 2002 when the sensor detects that the gun has been fired. Alternatively, the sensor interface section 2001 can connect to a device, such as the paintball gun, that provides a positive or negative signal when the gun is fired. The motor drive section 2002 receives the signal from the sensor interface section and activates the motor 2012 for a predetermined period time.

The motor drive section 2002 includes connections to a DC power source, a first switch 2006, a second switch 2008 and a timer section 2010. The first switch 2006 controls an electrically conducting path between the DC power source, motor 2012 and ground. The second switch 2008 controls an electrically conducting path between the DC power source and timer section 2010.

When the first switch 2006 is closed, a circuit path including power source 2004, motor 2012 and circuit ground is completed and the motor 2012 receives current causing it to operate. When switch 2006 is open, the electrically conducting path between the power source 2004, motor 2012 and ground is broken and motor 2012 receives no current, causing it to stop. The second switch 2008 controls an electrical connection between the power source 2004 and the timer section 2010.

Referring again to FIG. 20, the timer circuit includes capacitor 2014, resistors 2016 and 2032 and a resistor bank 2018. When the second switch 2008 is closed, the capacitor 2014 is charged through power source 2004. After the capacitor 2014 reaches a threshold voltage, the first switch 2006 is placed in a conducting or closed state so as to allow current to flow to the motor 2012 as discussed above. The power source 2004 will only be electrically connected to capacitor 2014 while an acceptable signal is being received from the sensor interface circuit 2000. After the power source is disconnected from capacitor 2014, capacitor 2014 begins to discharge through resistors 2016 and 2032 and, if used, resistor bank 2018. Once the capacitor voltage falls below the threshold valued, the first switch 2006 opens and motor operation ceases.

The rate of capacitor discharge can be controlled by incorporating one or more of the resistors of resistor bank 2018 into the circuit. This may be accomplished through the use of jumpers to select one or more resistors. Alternatively, the resistor bank 2018 can be replaced with a variable resistor such as a potentiometer.

As discussed above, the second switch 2008 opens and closes in response to signals received from the sensor interface section 2001. Preferably, the sensor interface section is capable of selectively interfacing to an integral sensor mounted on the paintball feeder or to an external device that provides a signal when the gun the fired. An example of an external device is the paintball gun itself or one or more components of the paintball gun. For example, if the paintball gun has an electronic trigger mechanism, then the sensor interface section can be electrically coupled to the trigger mechanism so that it receives the firing signals generated by the trigger mechanism. If a signal from an external device is used, the device is connected to the sensor interface at an input terminal 2019. An input select switch 2020 is used to select between positive or negative signals or, alternatively, is used to select an integral feeder sensor 2022. An example of where the integral sensor can be mounted is shown in FIGS. 18 and 19D. The integral sensor 2022 can be implemented in a variety of ways. For example, it may be implemented as an accelerometer, a sound detector, a vibration detector, an air pressure sensor, or other suitable device that detects the firing of the paintball gun. A Model 73B34R73C piezoelectric device manufactured by "Murata" is known to be suitable. The input select switch 2020 can be implemented in any number of ways, such as by using a set of jumpers. The negative input is selected for connection to a device that provides a negative or ground signal when the gun is fired. The positive input is used for connection to a device that provides a positive signal when the gun is fired. The remaining input is used in conjunction with the integral sensor 2022 when the integral sensor 2022 is employed. When an external device that provides a negative or ground signal is used, the sensor can be directly connected to signal line 2024.

Referring again to FIG. 20, the switch 2008 is arranged so that it will conduct when the negative or ground signal is present on signal line 2024. Such operation can be achieved by using, for example, a p-channel type MOSFET as the second switch 2008. If the input select circuit 2020 is configured for a positive input or for use with integral sensor 2022, the signal is first presented to switch 2024 which connects signal line 2024 to ground when a signal from the sensor is present thereby placing switch 2008 in a closed or conducting state.

In the embodiment shown, integral sensor 2022 provides a signal that is added to a DC voltage provided by a voltage divider circuit formed by resistors 2028 and 2026. In this manner, the level of the signal provided by sensor 2022 can be adjusted without the need for complex amplification circuitry. Preferably, resistor 2026 is adjustable so that the sensitively of the circuit can be adjusted. For example, resistor 2026 can be implemented as a potentiometer.

Optionally, the control circuit can be provided with a user-controlled switch 2030. The user controlled switch 2030 can be used to bypass the sensor interface circuit 2000 and the second switch 2008 in the motor control circuit. When the switch 2030 is depressed, an electrical connection between the power source 2004 and timer circuit 2010 is provided thereby charging capacitor 2014 and closing the first switch 2006 in the motor control circuit 2002. In this manner, the user can activate the motor even in the absence of a sensor signal. Such operation is useful, for example, in order to load the feeder with paintballs before the gun is first fired.

Advantageously, the sensor interface circuit and motor control circuit are relatively passive and very little power is consumed in the absence of a firing signal. As a result a separate on/off switch is not required to conserve power drain from the power source 2004 during periods of non-use. An example of where control circuit 2000 may be located, including switch 2030, is generally shown in FIG. 19C.

It will be appreciated by those skilled in the art that, although the foregoing control circuit has been described using particular components, any suitable circuitry can be used to implement the control circuit. For example, the first, second and third switches can be implemented as relays, bipolar transistors or any device capable of effectively making or breaking an electrical circuit. Timer circuit 2010 can be implemented, as any suitable timer circuit for controlling the period of time the motor is active. The integral sensor 2022 or external sensors may further be connected to an amplifier circuit. The sensor signals may further be routed through a filter circuit to help reduce false activation of the motor control circuit 2002. Such circuits are conventional and need not be further described.

Since the system, in any aspect described above, is preferably operated only in response to the firing of the paintball gun and then automatically shuts off, battery power is efficiently utilized, thereby advantageously prolonging the operating life of the battery. In standby mode, i.e. non-firing mode, the control circuit is preferably designed for low power consumption such that an on/off switch is not required. When the gun will be stored for prolonged periods of time, power can be disconnected from the battery using an optional on/off switch or alternatively by manually disconnecting the battery. The invention provides a simple, rugged, and relatively inexpensive construction, yet reliably provides for automatic, paintball jam prevention without the previous necessity of manually shaking the gun and thereby disrupting both the aiming and firing thereof.

Given the addition of power via battery to the gun, further electronic features may be added to the hopper feeder of the present invention. For instance, a liquid crystal display (LCD) may be added which displays various recorded or measured values to the user. For instance, in aspects where a gun sensor is actuated by firing, an additive circuit may be employed which tracks number of shots fired and rate of firing in cooperation with a built in timer. Further, where a preset number of paintballs are added to the hopper, the circuitry may enable a tracking such that the number of remaining paintballs may be tracked. Further, a timer may be used to disclose the remaining time or elapsed time in a game. Any or all of such information may then be displayed on the LCD. Other types of displays can alternatively and/or additionally be used, such as LED displays, analog displays, and their equivalents.

The invention further provides methods of feeding paintballs to a paintball gun using the paintball feeders of the invention. In a first method, a source of paintballs to be fed to a paintball feeder and a paintball feeder is provided. Then paintballs are fed to the paintball feeder. A first compliant component and a second component, with distance between them being smaller than the diameter of the paintballs, as discussed above, engage the paintballs, such that the first moveable compliant component yields to the paintball upon contact and imparts movement to the paintballs to feed them to the paintball gun.

In other methods provided by the invention, a paintball container is provided and connected to one of the paintball feeders of the invention, and paintballs are fed from the container to one of the connected paintball feeder. Thus, in a second method, a first compliant rotating disk and a drive channel engage the paintballs fed from the container, and the first compliant disk imparts movement to the paintballs causing them to be fed to the paintball gun. In a third method, a first compliant rotating disk and a second compliant rotating disk engage the paintballs, and both compliant disks impart movement to the paintballs to feed them to the paintball gun. In a fourth method, a first compliant conveyor belt and a drive channel engage the paintballs, and the first compliant conveyor belt imparts movement to the paintballs and thus feeds them to the paintball gun. In a fifth method, a first compliant conveyor belt and a second compliant conveyor belt engage the paintballs and impart movement to them to feed them to the paintball gun.

All references, including publications, patent applications and patents, cited herein are hereby incorporated by reference to the same extent as if each reference were individually and specifically indicated to be incorporated by reference and were set forth in its entirety herein. The use of the terms "a" and "an" and "the" and similar referents in the context of describing the present invention (especially in the context of the following claims) are to be construed to cover both the singular and the plural, unless otherwise indicated herein or clearly contradicted by context. The use of terms "including", "having" and "comprising" and like terms are to be construed as open ended terms, meaning including, but not limited to, unless otherwise indicated, or clearly contradicted by context, herein. The use of any and all examples, or exemplary language (e.g., "such as") provided herein is intended merely to better illuminate the present invention does not pose a limitation on the scope of the claimed invention. No language in the specification should be construed as indicating any non-claimed element as essential to the practice of the invention.

The foregoing is an integrated description of the invention as a whole, not merely of any particular element of facet thereof. The description describes "preferred embodiments" of this invention, including the best mode known to the inventors for carrying it out. Of course, upon reading the foregoing description, variations of those preferred embodiments will become obvious to those of ordinary skill in the art. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is possible unless otherwise indicated herein or otherwise clearly contradicted by context.

What is claimed is:

1. A feeder for a paintball gun, the feeder comprising:

a housing, the housing having an inlet channel for receiving the paintball and an outlet channel for delivering the paintball into the paintball gun;

a rotatable feed mechanism disposed within the housing, the rotatable feed mechanism comprising first and second rotating disks, each of the first and second rotating disks having two sides including an interior planar surface and an exterior surface, wherein the interior planar surfaces of the rotating disks frictionally engage the paintball when the paintball is received in the inlet channel; and a motor for actuating the feed mechanism to transfer the paintball from the inlet channel to the outlet channel.

2. The feeder of claim 1 further comprising a spindle disposed on the feeder housing, wherein the feed mechanism is rotationally mounted on the spindle.

3. The feeder of claim 1 wherein the first rotating disk and the second rotating disk are spaced apart from one another at a distance, the distance being less than a diameter of the paintball.

4. The feeder of claim 3 wherein at least one of the first and second rotating disks flex to accommodate the paintball so that the paintball is frictionally engaged between the first and second rotating disks.

5. The feeder of claim 3 wherein the first and second rotating disks are spaced apart by a disk spacer.

6. The feeder of claim 5 wherein the disk spacer is substantially cylindrical.

7. The feeder of claim 1 wherein the feeder housing comprises a first shell and a second shell, wherein the second shell comprises a spindle on which the feed mechanism is rotateably mounted.

8. The feeder of claim 1, further comprising:

a control circuit; and a sensor electrically coupled to the control circuit, wherein the sensor senses when the paintball gun has been fired and generates a signal in response thereto, and wherein the control circuit activates the motor in response to the signal.

9. The feeder of claim 8 wherein the sensor is mounted to the feeder housing.

10. The feeder of claim 8 wherein the control circuit selectively operates the motor for a period time and wherein the period of time is adjustable.

11. The feeder of claim 8, wherein the sensor is selected from the group consisting of a sound detector, an air pressure detector and vibration detector.

12. A feeder for feeding a paintball into a paintball gun, the feeder comprising:

a feed mechanism, the feed mechanism comprising first and second rotating disks, each of the first and second rotating disks having two sides including an interior planar surface and an exterior surface, wherein the interior planar surfaces of the rotating disks frictionally engage the paintball;

one or more drive components coupled to the feed mechanism;

a motor comprising a shaft, the shaft being coupled to the one or more drive components so that when the motor is activated, the shaft rotates and causes corresponding rotation of the one or more drive components to cause the feed mechanism to transport the paintball through the paintball feeder and into the paintball gun; and a circuit that detects when the paintball gun is fired and activates the motor in response thereto.

13. The feeder of claim 12 wherein the motor shaft is frictionally engaged to at least one of the one or more drive components via a drive belt.

14. The feeder of claim 12 wherein the one or more drive components comprise one or more gears.

15. The feeder of claim 12 wherein a space between the first rotating disk and the second rotating disk is less than a diameter of the paintball.

16. A feeder for a paintball gun, the feeder comprising:

a housing that defines a first chamber, a second chamber, an inlet channel in communication with the first chamber and an outlet channel in communication with the paintball gun;

a rotatable feed mechanism disposed within the first chamber, the feed mechanism comprising a first disk and a second disk having a gap therebetween, each of the first and second disks having two sides including an interior planar surface and an exterior surface wherein the interior planar surfaces of the first and second disks frictionally engage paintballs within the gap as the paintballs enter the first chamber through inlet channel;

a motor disposed within the second chamber and mechanically coupled to the rotatable feed mechanism so that, when energized, the motor actuates the rotatable feed mechanism to transport paintballs from the inlet channel, through the first chamber, and out of the outlet channel.

17. The feeder of claim 16, wherein at least one of the first and second disks flexes to accommodate the paintballs as the first and second disks frictionally engage the paintballs.

18. The feeder of claim 16, further comprising a spacer disposed between the first and second disks, wherein the spacer maintains the gap between the first and second disks.

19. The feeder of claim 16, further comprising a sensor circuit for detecting when the paintball gun has been fired and generating a signal in response thereto, wherein the motor activates in response to the signal.

20. The feeder of claim 19, further comprising a bypass switch for activating the motor in the absence of the signal.

* * * * *